US005780215A

United States Patent [19]

Ito

[11] Patent Number: 5,780,215

[45] Date of Patent: Jul. 14, 1998

[54] SILVER HALIDE COLOR PHOTOGRAPHIC LIGHT-SENSITIVE MATERIAL

[75] Inventor: Mineko Ito, Hino, Japan

[73] Assignee: Konica Corporation, Tokyo, Japan

[21] Appl. No.: 681,515

[22] Filed: Jul. 23, 1996

[30] Foreign Application Priority Data

| | | | |
|---|---|---|---|
| Jul. 26, 1995 | [JP] | Japan | 7-190483 |
| Jul. 26, 1995 | [JP] | Japan | 7-190484 |
| Jul. 26, 1995 | [JP] | Japan | 7-190485 |

[51] Int. Cl.[6] ..... G03C 1/46

[52] U.S. Cl. ..... 430/531; 430/533; 430/538; 430/552; 430/558

[58] Field of Search ..... 430/552, 558, 430/531, 533, 567, 538

[56] References Cited

U.S. PATENT DOCUMENTS

| | | | |
|---|---|---|---|
| 4,579,815 | 4/1986 | Kiritani et al. | 430/538 |
| 4,795,696 | 1/1989 | Sasaki et al. | 430/512 |
| 5,009,989 | 4/1991 | Aoki et al. | 430/512 |
| 5,290,668 | 3/1994 | Ohtani | 430/496 |
| 5,573,898 | 11/1996 | Sakai | 430/503 |

FOREIGN PATENT DOCUMENTS

| | | |
|---|---|---|
| 0 602 446 A1 | 6/1994 | European Pat. Off. . |
| 2 088 747 | 6/1982 | United Kingdom . |

*Primary Examiner*—Thorl Chea

*Attorney, Agent, or Firm*—Finnegan, Henderson, Farabow, Garrett & Dunner, L.L.P.

[57] ABSTRACT

A silver halide color photographic material comprises a paper support, and provided thereon, a light sensitive silver halide emulsion layer and a non-light sensitive layer, said support comprising a paper base and a resin layer coated on each side of the paper base, the resin layer on the silver halide emulsion layer side comprising two or more resin layers containing white pigment and having a different white pigment content, at least one of the resin layers being composed of a polyolefin or polyester resin, and at least another one layer being composed of a resin selected from the group consisting of a polyester resin, a polyether resin, a polyurethane resin, a polycarbonate resin, a polystyrene resin, a cellulose derivative and an electron beam hardened rein, wherein the silver halide emulsion layer comprises a silver halide emulsion having a silver chloride content of 95 to 99.9 mol % and contains at least one cyan coupler selected from a compound represented by the following Formula |C-1| or, Formula |I|, |II|, |III| or |IV|.

7 Claims, No Drawings

SILVER HALIDE COLOR PHOTOGRAPHIC LIGHT-SENSITIVE MATERIAL

FIELD OF THE INVENTION

The present invention relates to a silver halide color photographic light sensitive material (hereinafter referred to also as a light sensitive material) and particularly to a silver halide color photographic light sensitive material, which can provide reduced aging deterioration of glossiness and image sharpness, reduced aging coloration of white background and an image with excellent fastness.

BACKGROUND OF THE INVENTION

As silver halide color photographic light sensitive materials become more popular, high quality images have been demanded. Under such circumstances, studies on improvement of color reproduction, image storage stability and image sharpness have been made in color print light sensitive materials.

Irradiation or halation is generally known as a factor influencing image sharpness. The former is caused by scattering of incident light due to silver halide grains or coupler oil drops dispersed in a gelatin layer. The degree of the scattering depends mainly on the amount of the gelatin, silver halide grains and oil drops. The degree of the latter depends on the degree of light reflected from a support and on reflectance or refractive index of the support.

Dyes have been improved for anti-irradiation. This is disclosed in Japanese Patent O.P.I. Publication Nos. 50-145125/1975, 52-20830/1977, 50-111641/1975, 61-148448/1986, 61-151650/1986, 62-275562/1987 and 62-283336/1987.

A method of providing an anti-halation layer is known as an anti-halation method. The improvement is disclosed in, for example, Japanese Patent O.P.I. Publication Nos. 55-33172/1980, 59-193447/1984, 59-151650/1984 and 62-33448/1987.

These methods improve image sharpness but cause marked lowering of sensitivity, and it is difficult to improve image sharpness, while maintaining practically sufficient sensitivity.

The improvement of a support has been studied. Recently, a waterproofing support, in which a polyolefin is laminated on a base paper, is used as a support of a color print light sensitive material for rapid processing. White pigment such as titanium oxide is dispersed in a polyolefin layer on the silver halide emulsion layer side to secure image sharpness and white background. As disclosed in Japanese Patent O.P.I. Publication Nos. 54-46035/1979, 64-18144/1989 and 2-71256/1990, the use of a support in which the polyolefin layer on the silver halide emulsion side contains more white pigment is effective but not satisfactory. The support further has disadvantages in that smoothness of the polyethylene layer deteriorates and adhesion between the polyethylene layer and the emulsion layer also deteriorates.

The color print using the above described support exhibits a problem in that discoloration of the white background (after-yellowing) during long term storage occurs. Improvement of the defect has been demanded.

The color reproduction method based on the so-called subtractive color system, which employs a yellow, magenta and cyan dye, is used in widespread color print. The degree that a color image obtained from a light sensitive material for color print reproduces an original image depends on photographic properties of the light sensitive material. The light sensitive material for color print giving excellent color image reproduction has been studied from various points of view. How wide a range of color can be reproduced in color print depends on color tone of the above described dye used as a primary color dye, and therefore, development of dyes having an excellent light absorption property has been an important problem to be solved in the art. The dye having a light absorption profile which is broad or has undesirable side absorption can not provide excellent color reproduction of the original color image.

In a silver halide photographic light sensitive material for color print, a compound having active methylene or another active point in the molecule is usually used as so-called a dye-forming coupler forming yellow, magenta and cyan dyes. The example of the yellow dye-forming coupler includes pivaloylacetoanilides, the example of the magenta dye-forming coupler includes 5-pyrazolones, and the example of the cyan dye-forming coupler includes phenols and naphthols.

Of these, phenols and naphthols used as a cyan dye-forming coupler have undesirable side absorption in the region of a blue or green light wavelength, and also have a problem in that color reproduction markedly deteriorates and image fastness is relatively poor under high temperature and high humidity.

As a method for overcoming this problem is proposed a cyan coupler having an alkyl group in a 5-position of the phenols, a pyrazoloazole cyan coupler as disclosed in Japanese Patent O.P.I. Publication Nos. 64-552/1989, 64-553/1989, 64-554/1989, 64-555/1989, 64-556/1989, 64-557/1989 and 1-144052/1989, a pyrroloazole cyan coupler as disclosed in Japanese Patent O.P.I. Publication Nos. 4-174429/1992, 4-230746/1992, 5-165172/1993, 5-204107/1993, 5-313324/1993 and 5-313325/1993 and a cyan coupler as disclosed in Japanese Patent O.P.I. Publication Nos. 4-133055/1992 and 5-232648/1993. A cyan dye image obtained from these couplers is excellent in color reproduction, but is not satisfactory in image fastness under high temperature and high humidity. Further, a color print image obtained from a light sensitive material employing these couplers shows aging deterioration of glossiness and image sharpness, and the improvement is desired.

SUMMARY OF INVENTION

Accordingly, a first object of the invention is to provide a silver halide color photographic light sensitive material which can provide reduced aging deterioration of glossiness.

A second object of the invention is to provide a silver halide color photographic light sensitive material which can provide reduced aging deterioration of image sharpness.

A third object of the invention is to provide a silver halide color photographic light sensitive material which can provide an image with excellent fastness.

A fourth object of the invention is to provide a silver halide color photographic light sensitive material which can provide reduced aging coloration of white background.

DETAILED DESCRIPTION OF THE INVENTION

The above object of the invention could be attained by the following constitution:

1. A silver halide color photographic material comprising a paper support, and provided thereon, a light sensitive silver halide emulsion layer and a non-light sensitive layer, said support comprising a paper base and a resin layer coated on each side of the paper base, the resin layer on the silver halide emulsion layer side comprising two or more resin layers containing white pigment and having a different white pigment content, at least one of the resin layers being composed of a polyolefin or polyester resin, and at least another one layers being composed of a resin other than the polyolefin resin, wherein the silver halide emulsion layer comprises a silver halide emulsion having a silver chloride content of 95 to 99.9 mol % and contains at least one cyan coupler selected from a compound represented by Formula |C-1| or, Formula |I|, |II|, |III| or |IV|:

Formula |C-1|

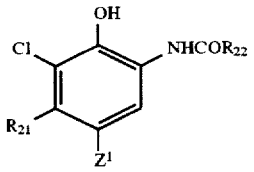

wherein $R_{21}$ represents an alkyl group having 2 to 6 carbon atoms; $R_{22}$ represents a ballast group; and $Z^1$ represents a hydrogen atom or an atom or group capable of being released on reaction with an oxidation product of a color developing agent.

Formula |I|

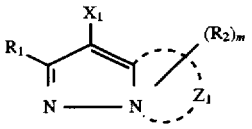

Formula |II|

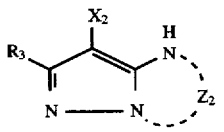

Formula |III|

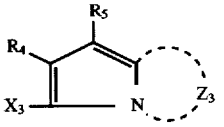

Formula |IV|

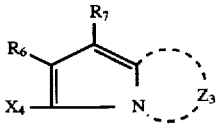

wherein $R_1$ represents a hydrogen atom or a substituent; $R_2$ is a substituent; m is the number of substituent $R_2$, provided when m is zero, $R_1$ represents an electron attractive group having a Hammett's substituent constant $\sigma_p$ of not less than 0.20, while when m is 1, 2 or more, at least one of $R_1$ and $R_2$ represents an electron attractive group having a Hammett's substituent constant $\sigma_p$ of not less than 0.20; $Z_1$ represents a group of non-metallic atoms necessary to form a nitrogen-containing 5-membered heterocyclic ring which may be condensed with a benzene ring; $R_3$ represents a hydrogen atom or a substituent; $Z_2$ represents a group of non-metallic atoms necessary to form a nitrogen-containing 6-membered heterocyclic ring together with —NH—, which may have a substituent and may be condensed with a benzene ring; $R_4$ and $R_5$ each represent an electron attractive group having a Hammett's substituent constant $\sigma_p$ of not less than 0.20, provided the sum of $\sigma_p$ values of $R_4$ and $R_5$ is not less than 0.65; $Z_3$ represents a group of non-metallic atoms necessary to form a nitrogen-containing 5-membered heterocyclic ring, which may have a substituent; $R_6$ and $R_7$ each represent a hydrogen atom or a substituent; $Z_4$ represents a group of non-metallic atoms necessary to form a nitrogen-containing 6-membered heterocyclic ring, which may have a substituent; and $X_1$, $X_2$, $X_3$ and $X_4$ each represent a hydrogen atom or a group capable of being released upon a coupling reaction with an oxidation product of color developing agent.

Next, the invention will be explained in detail.

The support in the invention comprises a base paper, and a resin layer provided on each side of the paper, and the resin layer on a silver halide emulsion layer side (hereinafter an obverse resin layer) comprising two or more layers containing white pigment.

The base paper used in the invention is selected from a conventional material generally used in a photographic print, but paper is usually used. For example, the base paper includes natural pulp, synthetic pulp, a mixture thereof and material for various combination paper. Generally, natural pulp containing mainly a coniferous tree pulp, a broadleaf tree and a mixture thereof are widely used. Neutral paper, acidic paper or various other papers can be used, but paper for photographic use is preferably used and neutral paper for photographic use is especially preferable. The thickness of paper is preferably 40 to 250 μm.

The support described above may contain additives such as a sizing agent, a fixing agent, a reinforcing agent, a filling agent, an anti-static agent, a dye or an anti-foggant and which are used in paper manufacture. A surface sizing agent, a surface reinforcing agent and an antistatic agent may be coated on the surface of the support.

In the support in the invention, a method providing a resin layer (hereinafter referred to as a reverse resin layer) on the side opposite the silver halide emulsion layer includes lamination of a polyolefin or a polyester resin such as a polyethylene terephthalate resin on the base paper.

The olefin resin used in the lamination can be selected from polyethylene, poly-α-olefins and a mixture containing at least the two. The polyolefin resin widely used is low density polyethylene, high density polyethylene or a mixture thereof.

Generally, the lamination of a resin is carried out by extrusion coating a resin composition on a support. In order to carry out this coating, the resin composition is melt-extruded in a single layer or plural layers from a slit die of an extrusion apparatus.

Usually, melt-extrusion temperature is preferably 200° to 350° C.

The thickness of the resin layer is not specifically limited, but usually 15 to 60 μm.

The paper support used in the invention has two or more surface resin layers containing white pigment in which at least one resin layer is composed of a polyolefin or polyester resin and at least another one resin layer is composed of a resin, other than a polyolefin resin, preferably a electron beam hardenable resin.

The resin layer composed of a polyolefin or polyester resin is preferably a resin layer composed of a polyolefin resin.

The polyolefin resin in the invention is selected from polyethylene, poly-α-olefins and a mixture containing at least the two. The widely used polyolefin resin is a low density polyethylene, a high density polyethylene or a mixture thereof.

The polyester useful for the invention includes polyethylene terephthalate and a modified polyester comprising a polyethylene terephthalate unit as a main component (hereinafter referred to as simply a modified polyester). The modified polyester is composed of a polyethylene terephthalate unit portion as a most part and a modified portion in the main chain. The dicarboxylic acid capable of constituting the ester part of the modified portion includes terephthalic acid, isophthalic acid, 2,6-naphthalene dicarboxylic acid, 1,5-naphthalene dicarboxylic acid, 1,4-naphthalene dicarboxylic acid, 2,7-naphthalene dicarboxylic acid, p-xylidene dicarboxylic acid, 1,4-dicyclohexane dicarboxylic acid, adipic acid, sebatic acid, 5-alkalimetalsulfo isophthalic acid or 4-alkalimetalsulfo-2,6-naphthalene dicarboxylic acid.

The glycol (diol) capable of constituting the ester part of the modified portion includes ethylene glycol, propylene glycol, 1,4-butane diol, 1,4-hexylene diol, diethylene glycol, triethylene glycol, tetraethylene glycol, polyethylene glycol (number average molecular weight 300 to 30,000) and polypropylene glycol (number average molecular weight 300 to 30,000).

The dibasic acid preferably includes terephthalic acid, isophthalic acid, 4-metalsulfo-2,6-naphthalene dicarboxylic acid, and 4-metalsulfo-isophthalic acid. The glycol preferably includes ethylene glycol, propylene glycol, 1,4-cyclohexanedimethanol and polyethylene glycol (having a number average molecular weight of 300 to 30,000).

The alkalimetal ion of the alkalimetalsulfo group includes a sodium, potassium, lithium, and cesium ion, and preferably a sodium ion.

The modified portion content of the modified polyester useful for the invention is not more than 50 mol % based on the total ester bond. When the modified portion exceeds 50 mol %, for example, mechanical strength, glass transition temperature and water proof is deteriorated, and therefore, it is difficult to use it as a support. The content is preferably not more than 40 mol %, and more preferably not more than 30 mol %.

The content of a compound having an alkalimetalsulfo group in the modified portion of the modified polyester is preferably 2 to 10 mol % based on the total ester bond, wherein its adhesion to an emulsion layer, another resin layer or paper is excellent. When the content of the compound having an alkalimetalsulfo group, for example, 5-sodiumsulfo isophthalic acid is not more than 2 mol %, the modified polymer is not substantially different from polyethylene terephthalate and is almost the same as an unmodified polyester. When the content is not less than 10 mol %, the modified polymer increases water absorption, and adhesion between the resin layer and the paper support is decreased. As a result, there occur problems as a photographic support that the separation of the resin layer from the paper support occurs in a photographic process or water proofing of the support deteriorates. The content of the compound is preferably 2 to 7 mol %, and more preferably 3 to 6 mol %.

As the ester part of the modified portion, besides the above sulfo compound, polyethylene glycol and/or an aliphatic dicarboxylic acid, for example, adipic acid, are preferably used.

The modified polyester useful for the invention can be synthesized according to a conventional synthetic method of polyesters. For example, esterification is carried out by direct reaction of a dicarboxylic acid and a glycol or ester exchange reaction of a diester and a glycol. Polyesters can be synthesized by optionally using an ester exchange catalyst in the ester exchange reaction or using a polymerization catalyst such as antimony oxide in the polymerization. The component constituting the polyester or the synthetic method of the polyester can be referred to for example, Kobunshi Jikken Kagaku, Vol. 5 (Kyoritsu Shuppan), "Polycondensation and Addition polymerization" page 103–136 (1980) or "Gosei Kobunshi" (Asakura Shoten), page 187–286 (1971).

The typical synthetic methods of the modified polyester are disclosed in U.S. Pat. No. 4,217,441 and Japanese Patent O.P.I. Publication No. 5–210119/1993, and the modified polyester useful for the invention can be synthesized according to these methods.

The molecular weight of the polyester (including a modified polyester) useful for the invention needs to be sufficiently high. Generally, the molecular weight of a polymeric compound such as polyester is expressed in terms of intrinsic viscosity (see, for example, Nihon Kagakukai edition, "Hyoujun Kagakuyogo Jiten", p. 24, 1991, Maruzen). The intrinsic viscosity of the polyester used in the invention needs to be not less than 0.50, is preferably not less than 0.53, and more preferably not less than 0.55. When the intrinsic viscosity is not more than the described above, the resin whitens and be brittle after the melt-extrusion. The melt-extrusion of the polyester containing moisture greatly reduces the intrinsic viscosity, since hydrolysis occurs during the extrusion. Even if the intrinsic viscosity is sufficiently high, much attention must be paid to drying before the extrusion of the polyester. The resin chips are usually dried at about 150° C. and at a pressure of $10^{-3}$ Torr.

The polyolefin or polyester resin layer is formed by melt-extrusion coating the polyolefin or polyester resin on a paper support. The resin composition is melted at a specific temperature in a melt-extrusion machine, and melt-coated from a die-slit on a moving paper support (a coating position is supported by a roller provided on the side of the paper opposite the coated side). The melt-coated resin layer may be a single layer extruded from a single slit or plural layers extruded from plural slits.

Usually, melt-extrusion temperature is preferably 200° to 350° C.

The resin other than the polyolefin resin in the invention includes the polyester resin described above, a polyether resin such as polyethylene glycol, polyoxymethylene or polyoxypropylene, a urethane resin such as polyester urethane or polyether urethane, a polycarbonate resin, a polystyrene resin, an electron beam hardened resin, a cellulose derivative such as cellulose nitrate or cellulose triacetate, and they are used singly or in admixture. The preferable resin is a polyethylene terephthalate resin, a modified polyester resin or an electron beam hardenable resin, and these resins may be used singly and in admixture with another resin as described above.

Any electron beam hardenable compound for the electron beam hardened resin useful for the invention may be used, as long as it can be hardened by electron beam irradiation. The electron beam hardenable compound in the invention includes an electron beam hardenable compound disclosed in Japanese Patent Publication No. 60-17104/1985 and Japanese Patent O.P.I. Publication Nos. 60-126649/1985 and 2-157747/1990, that is, an electron beam hardenable monomer or oligomer. The monomer or oligomer useful for the invention capable of being hardened by electronic beam irradiation includes an unsaturated compound containing two or more double bonds in its molecule, for example, an acryl or methacryl oligomer, a multifunctional acryl or methacryl monomer. In addition, the monomer by which the above described hardenable monomer is diluted includes an unsaturated compound containing at least one double bond in one molecule such as an acryl, methacryl or vinyl monomer.

The acryl or methacryl oligomer includes an acryl or methacryl ester of polyurethane, an acryl or methacryl ester of polyetheralcohol, an acryl or methacryl ester of bisphenol A, and a maleic or fumalic ester of polyester. The multifunctional acryl or methacryl monomer includes 1,6-hexanedioldiacrylate, neopentyldiacrylate, diethyleneglycol diacrylate, butadieneacrylate, diethyleneglycol dimethacrylate, tetraethyleneglycol diacrylate, grycerolmethacrylate, stearylacrylate, polyethyleneglycol diacrylate, butoxyethylacrylate, 1,3-butanedioldiacrylate, ethyleneglycol dimethacrylate, glycidylmethacrylate, methylacrylate, ethylacrylate, butylacrylate, 2-hydroxyethylacrylate, 2-hydroxyethylmethacrylate, 2-hydroxypropylacrylate, phenoxyethylacrylate, cyclohexylacrylate, benzylacrylate, N,N-dimethylaminoethyl-acrylate, N,N-diethylaminoethylacrylate, ethyleneoxide modified phenoxyphosphoricacrylate, neopentylglycoldiacrylate, isocyanuric diacrylate, isocyanuric triacrylate, trimethylolpropanetriacrylate, propyleneoxide modified trimethylolpropanetriacrylate, glycidylmrthacrylate, 1,3-bis(N,N-diepoxypropylaminomethyl)cyclohexane, trimethylolpropanetriacrylate, pentaerythritolacrylate, and pentaerythritolpentaacrylate.

The unifunctional acryl, methacryl or vinyl monomer includes styrene, N-vinylpyrrolidone, polyoxyethylenephenylalcohol acrylate, and 2-ethylhexylacrylate.

The coating method includes a roller coating method and a conventional method used for sheet coating such as a bar coat method, a air-doctor coat method, a blade coat method, a squeeze coat method, a air-knife coat method, a reverse-roll coat method, a fountain coat method or a silt orifice coat method.

The electron beam irradiation machine is not specifically limited, and generally a curtain beam method, which is relatively cheap and gives large output, is used as an electron beam accelerator. On electron beam irradiation, the accelerating voltage is preferably 100–300 kv, and the absorbed dose is preferably 0.5–10 Mrad.

The thickness of each of the polyolefin resin layer and the resin layer other than the polyolefin, which constitute a laminated layer, is not limited but usually 5 to 60 μm.

In the invention the obverse resin layer is a laminated layer composed of two or more resin layers, at least one comprising a polyolefin or polyester resin, at least another one comprising a resin other than the polyolefin resin and each layer having a different white pigment content. The white pigment content of the polyolefin or polyester resin layer is different from that of the resin layer other than the polyolefin resin layer. The average white pigment content of the two or more resin layers is preferably 16 weight % or more, and the white pigment content of the layer closest to the silver halide emulsion layer is preferably 1 to 25 weight %. The white pigment content of one layer of the two or more resin layers may be 0 weight %.

The average white pigment content herein referred to is an average content a value obtained by dividing the total white pigment content of the two or more layers with the total weight of the two or more layers. The average content is preferably 16 weight % or more, and more preferably 18 to 60 weight %.

The white pigment content of the resin layer closest to the silver halide emulsion layer is preferably 1 to 25 weight %, and more preferably 5 to 20 weight %.

The white pigment includes rutile type titanium dioxide, anatase type titanium dioxide, barium sulfate, barium stearate, silica, alumina, zirconium oxide and caorin, calcium carbonate, aluminium oxide, and magnesium oxide. Titanium dioxide is preferable for various reasons.

Titanium dioxide may be anatase or rutile type, but anatase type is preferable in view of whiteness and rutile type is preferable in view of sharpness. The mixture of rutile type and anatase type titanium dioxide is preferable in view of both whiteness and sharpness. Some layers of the multilayers may contain anatase type titanium dioxide and the others the rutile type titanium dioxide.

In order to restrain activity of titanium dioxide or to prevent after yellowing, the titanium dioxide may be surface treated with an inorganic substance such as hydrated aluminum or hydrated silicon oxide, an organic substance such as polyhydric alcohol, polyamine, metal soap, alkyl titanate or polysiloxane or a mixture thereof. In the surface treated titanium dioxide, the content of the inorganic substance is preferably 0.2 to 2.0 weight %, and the content of the organic substance is preferably 0.1 to 1.0 weight %, based on the titanium dioxide. The particle diameter of the titanium dioxide is preferably 0.1 to 0.4 μm.

In order to disperse white pigment in the resin, a three roll mill, a two roll mill, a colloid mill, a homogenizer, a sand grinder and an ultrasonic dispensing machine can be used.

Optionally, the surface of the resin layer after coating or hardening is smoothened by a mirror roller or is matted by a matting roller.

The cyan coupler represented by Formula [C-I] will be explained below.

In the cyan coupler represented by Formula [C-I], $R_{21}$ represents an alkyl group having 2 to 6 carbon atoms, which may be straight chained or branched or may have a substituent. $R_{21}$ preferably represents an ethyl group.

$R_{22}$ represents a ballast group which is an organic group giving size or shape enough to give bulkiness to a coupler molecule such that the coupler is not diffused from the coupler containing layer to another layer. The balast group preferably represents —CH($R_{23}$)—O—Ar.

$R_{23}$ represents an alkyl group having 1 to 12 carbon atoms, Ar represents an aryl group such as a phenyl group, which may have a substituent.

In Formula [C-1], the atom or group represented by $Z^1$, which is capable of being released on reaction with an oxidation product of a color developing agent, includes a halogen atom, an alkoxy group, an aryloxy group, an acyloxy group, a sulfonyloxy group, an acylamino group, a sulfonylamino group, an alkoxycarbonyl group, an aryloxycarbonyloxy group or an imido group, each of which may have a substituent, and is preferably a halogen atom, an alkoxy group or an aryloxy group.

The exemplified coupler represented by Formula [C-1] will be shown below, but the coupler is not limited thereto.

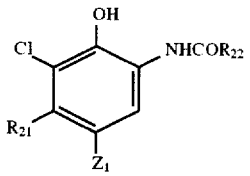
| Coupler No. | $R_{21}$ | $Z_1$ | $R_{22}$ |
|---|---|---|---|
| C-I-1 | $-C_2H_5$ | $-Cl$ | 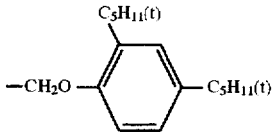 |
| C-I-2 | $-C_2H_5$ | 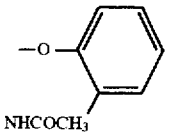 | 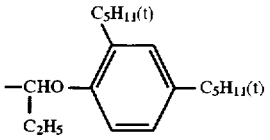 |
| C-I-3 | $-C_2H_5$ | $-Cl$ | 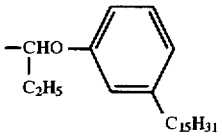 |
| C-I-4 | $-C_2H_5$ | $-Cl$ | 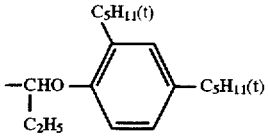 |
| C-I-5 | $-C_2H_5$ | $-F$ | 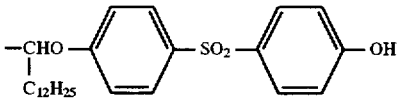 |
| C-I-6 | $-C_2H_5$ | $-F$ | 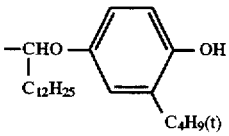 |
| C-I-7 | $-C_2H_5$ | $-Cl$ | 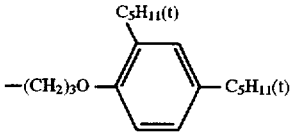 |
| C-I-8 | $-C_2H_5$ | $-Cl$ | 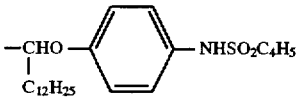 |
| C-I-9 | $-C_2H_5$ | $-Cl$ | 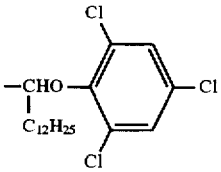 |
| C-I-10 | $-C_3H_7(i)$ | $-Cl$ | $-C_{18}H_{37}$ |

-continued
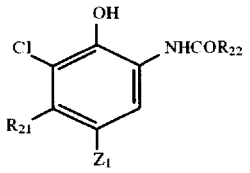
| Coupler No. | $R_{21}$ | $Z_1$ | $R_{22}$ |
|---|---|---|---|
| C-I-11 | $-C_6H_{13}$ | $-Cl$ | 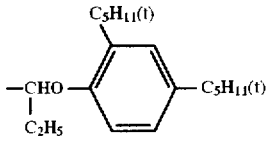 |
| C-I-12 | $-C_3H_7$ | $-Cl$ | 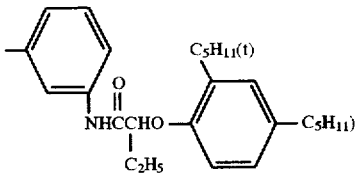 |
| C-I-13 | $-C_2H_4NHC(=O)CH_3$ | $-Cl$ | 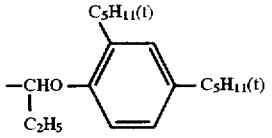 |
| C-I-14 | $-C_2H_4OCH_3$ | $-Cl$ | 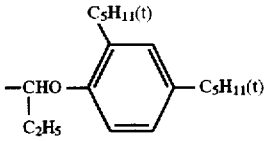 |
| C-I-15 | $-C_2H_5$ | $-Cl$ | 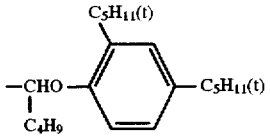 |
| C-I-16 | $-C_4H_9(t)$ | $-OCH_2CH_2-$* <br> *$-SO_2CH_3$ | 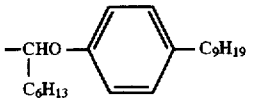 |
| C-I-17 | $-C_2H_5$ | $-Cl$ | 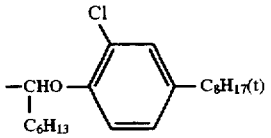 |
| C-I-18 | $-C_2H_5$ | $-Cl$ | 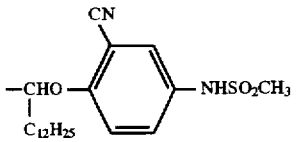 |
| C-I-19 | $-C_2H_5$ | $-Cl$ | 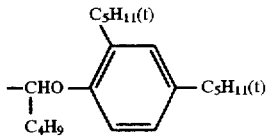 |
| C-I-20 | $-C_2H_5$ | $-Cl$ | $-C_{15}H_{31}$ |

The examples of the cyan coupler in the invention are described in Japanese Patent Publication No. 49-11572/1974, Japanese Patent O.P.I. Publication Nos. 61-3142/1986, 61-9652/1986, 61-9653/1986, 61-39045/1986, 61-50136/1986, 61-99141/1986, and 61-105545/1986.

The coupler in the invention represented by Formula |C-1| can be used in an amount of $1\times10^{-3}$ mol to 1 mol, and preferably $1\times10^{-2}$ to $8\times10^{-1}$ mol per mol of silver halide.

The coupler in the invention may be used in combination with other cyan couplers different from the coupler in the invention. The other couplers include a phenol type cyan coupler having a methyl group at a 5-position and a 2,5-diacylaminophenol type cyan coupler.

The cyan coupler represented by Formula |C-1| will be explained below.

Examples of the substituent according to the invention having a Hammett's substituent constant $\sigma_p$ of +0.20 or more are sulfonyl, sulfinyl, sulfonyloxy, sulfamoyl, phosphoryl, carbamoyl, acyl, acyloxy, oxycarbonyl, carboxyl, cyano, nitro, halogenated alkyl, halogenated alkoxy, halogenated aryloxy, pyrrolyl and tetrazolyl groups and a halogen atom.

The sulfonyl group includes alkylsulfonyl, arylsulfonyl, halogen-substituted alkylsulfonyl and halogen-substituted arylsulfonyl groups; the sulfinyl group includes alkylsulfinyl and arylsulfinyl groups; the sulfonyloxy group includes alkylsulfonyloxy and arylsulfonyloxy groups; the sulfamoyl group includes N,N-dialkylsulfamoyl, N,N-diarylsulfamoyl and N-alkyl-N-arylsulfamoyl groups; the phosphoryl group includes alkoxyphosphoryl, aryloxyphosphoryl, alkylphosphoryl and arylphosphoryl groups; the carbamoyl group includes N,N-dialkylcarbamoyl, N,N-diarylcarbamoyl and N-alkyl-N arylcarbamoyl groups; the acyl group includes alkylcarbonyl and arylcarbonyl groups; the acyloxy group includes alkylcarbonyloxy groups; the oxycarbonyl group includes alkoxycarbonyl and aryloxycarbonyl groups; the halogen-substituted alkoxy group includes a-halogen-substituted alkoxy groups; the halogen-substituted aryloxy group includes tetrafluoroaryloxy and pentafluoroaryloxy groups; the pyrrolyl group includes 1-pyrrolyl group; and the tetrazolyl group includes 1-tetrazolyl group.

Besides the above substituents there may also be suitably used a trifluoromethyl, heptafluoroisopropyl, nonylfluoro-t-butyl, tetrafluoroaryl or pentafluoroaryl group.

In Formula [I], among the substituents represented by $R_1$ or $R_2$, the substituents having a $\sigma_p$ of less than 0.20 include alkyl, aryl, anilino, acylamino, sulfonamido, alkylthio, arylthio, alkenyl, cycloalkyl, cycloalkenyl, alkynyl, heterocyclic, alkoxy, aryloxy, heterocylic oxy, siloxy, amino, alkylamino, imido, ureido, sulfamoylamino, alkoxycarbonylamino, aryloxycarbonylamino, alkoxycarbonyl, aryloxycarbonyl, heterocyclic thio, thioureido, hydroxy and mercapto groups, spiro compound residues, and closslinked hydrocarbon compound residues.

The above alkyl group includes a straight-chained or brancheded alkyl group having preferably 1 to 32 carbon atoms. The above aryl group is preferably a phenyl group.

The above acylamino group includes alkylcarbonylamino and arylcarbonylamino groups: the sulfonamido group includes alkylsulfonylamino and arylsulfonylamino groups. The alkyl component and the aryl component of the above alkylthio group and arylthio group correspond to the above alkyl groups and the aryl groups, respectively.

The alkenyl group may be either straight-chained or branched and includes those having 2 to 32 carbon atoms. The cycloalkyl group incudes those having preferably 3 to 12 carbon atoms, more preferably 5 to 7 carbon atoms. The cycloalkenyl group includes those having preferably 3 to 12 carbon atoms, more preferably 5 to 7 carbon atoms.

The ureido group includes alkylureido and arylureido groups; the sulfamoylamino group includes alkylsulfamoylamino and arylsulfamoylamino groups; the heterocyclic group is preferably a 5- to 7-membered cyclic group such as 2-furyl, 2-thienyl, 2-pyrimidinyl and 2-benzothiazolyl groups; the heterocyclic oxy group is preferably one having a 5- to 7-member heterocyclic ring such as 3,4,5,6-tetrahydropyranyl-2-oxy and 1-phenyltetrazole-5-oxy groups; the heterocyclic thio group is preferably a 5- to 7-membered heterocyclic thio group such as 2-pyridylthio, 2 benzothiazolylthio and 2,4-diphenoxy-1,3,5-triazole-6-thio groups; the siloxy group includes trimethylsiloxy, triethylsiloxy and dimethylbutylsiloxy groups; the imido group includes succinic acid imido, 3-heptadecylsuccinic acid imido, phthalimido and glutarimido groups; the spiro compound residue includes spiro|3.3|heptane-1-yl group; the closslinked hydrocarbon compound residue includes bicyclo|2.2.1|heptane-1-yl, tricyclo|3.3.1.1$^{3\ 7}$|decane-1-yl and 7,7-dimethyl-bicyclo|2.2.1|heptane-1-yl groups.

The above groups each may have further a substituent, a non-diffusible group such as a long-chain hydrocarbon group, a polymer residue, etc.

In Formula [I], the group represented by $X_1$ capable of be released upon reaction with an oxidation product of a color developing agent includes a halogen atom such as chlorine, bromine or fluorine, and alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclicthio, alkoxycarbonylthio, acylamino, sulfonamido, N atom-bonded nitrogen-containing heterocyclic, alkoxycarbonylamino, aryloxycarbonylamino and carboxyl groups. The preferred among these are a hydrogen atom and the alkoxy, aryloxy, alkylthio, arylthio, and N atom-bonded nitrogen-containing heterocyclic groups.

In Formula [I], the nitrogen-containing 5-membered heterocyclic ring formed with $Z_1$ includes pyrazole, imidazole, benzimidazole, triazole and tetrazole rings. The nitrogen-containing 5-membered heterocyclic ring may form a condensate with a benzene ring.

To be concrete, the compounds represented by Formula [I] comprise those represented by the following Formulas [I]-1 to [I]-7.

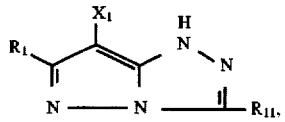

Formula [I]-1

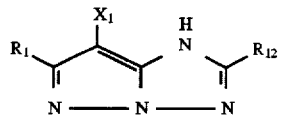

Formula [I]-2

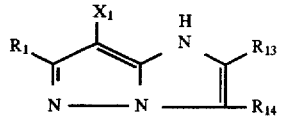

Formula [I]-3

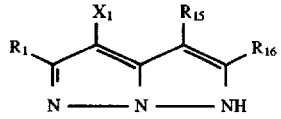

Formula [I]-4

-continued

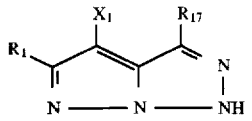

Formula [I]-5

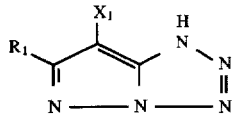

Formula [I]-6

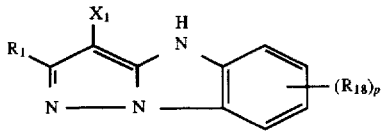

Formula [I]-7

In the above Formulas, at least one of $R_1$ and $R_{11}$ of Formula [I]-1, at least one of $R_1$ and $R_{12}$ of Formula [I]-2, at least one of $R_1$, $R_{13}$ and $R_{14}$ of Formula [I]-3, at least one of $R_1$, $R_{15}$ and $R_{16}$ Formula [I]-4, at least one of $R_1$ and $R_{17}$ of Formula [I]-5, $R_1$ of Formula [I]-6 and at least one of $R_1$, $R_{18}$ of Formula [I]-7 independently represent an electron attractive group having a $\sigma_p$ of not less than 0.20.

$X_1$ is the same as defined in $X_1$ of Formula [I]; and p is an integer of 0 to 4.

In Formulas [I]-1 to [I]-7, of the groups represented by $R_1$ and $R_{11}$ to $R_{18}$ those other than the non-electron-attractive group having a $\sigma_p$ of not less than 0.20 represent a hydrogen atom or a substituent having a $\sigma_p$ of less than 0.20; of the groups represented by $R_{18}$ those having a $\sigma_p$ of less than 0.20 can be any substituents without limit which, where the $R_1$ or $R_2$ in Formula [I] is one of those other than the electron-attractive group having a $\sigma_p$ of not less than 0.20, include those described as the substituent represented by the $R_1$ or $R_2$ of Formula [I].

The cyan coupler having the electron attractive group according to the invention can be easily synthesized according to appropriate one of the methods described in Japanese Patent O.P.I. Publication Nos. 64-554/1989, 64-555/1989, 64-557/1989, and 1-105251/1989.

The cyan coupler represented by Formula [II] will be explained.

The cyan coupler of Formula [III] is of a structure of a 6-membered heterocyclic ring condensate with a pyrazole ring, wherein the substituent represented by $R_3$ can be any group with no restriction; examples of it include alkyl, aryl, anilino, acylamino, sulfonamido, alkylthio, arylthio, alkenyl and cycloalkyl groups, and further a halogen atom, and cycloalkenyl, alkynyl, heterocyclic, sulfonyl, sulfinyl, phosphonyl, acyl, carbamoyl, sulfamoyl, cyano, alkoxy, sulfonyloxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic thio, thioureido, carboxyl, hydroxyl, mercapto, nitro and sulfo groups, and spiro compound residues and closslinked hydrocarbon conspound residues.

The alkyl group represented by $R_3$ may be a straight-chained or branched alkyl group having preferably 1 to 32 carbon atoms. The aryl group is preferably a phenyl group.

The acylamino group represented by $R_3$ includes alkylcarbonylamino and arylcarbonylamino groups; the sulfonamido group includes alkylsulfonylamino and arylsulfonylamino groups. The alkyl and aryl components of the alkylthio group and the arylthio group are the same as those defined for the alkyl group and the aryl group, respectively, represented by the above $R_3$.

The alkenyl group represented by $R_3$ may be a straight-chained or branched alkenyl group having preferably 2 to 32 carbon atoms. The cycloalkyl group is preferably one having 3 to 12 carbon atoms, more preferably 5 to 7 carbon atoms. The cycloalkenyl group is preferably one having 3 to 12 carbon atoms, more preferably 5 to 7 carbon atoms.

The sulfonyl group represented by $R_3$ includes alkylsulfonyl and arylsulfonyl groups; the sulfinyl group includes alkylsulfinyl and arylsulfinyl groups; the phosphonyl group includes alkylphosphonyl, alkoxyphosphonyl, aryloxyphosphonyl and arylphosphonyl groups; the acyl group includes alkylcarbonyl and arylcarbonyl groups; the carbamoyl group includes alkylcarbamoyl and arylcarbamoyl groups; the sulfamoyl group includes alkyl sulfamoyl and arylsulfamoyl groups; the acyloxy group includes alkylcarbonyloxy and arylcarbonyloxy groups; the carbamoyloxy group includes alkylcarbamoyloxy and arylcarbamoyloxy groups; the ureido group includes alkyl ureido and arylureido groups; the sulfamoylamino group includes alkylsulfamoylamino and arylsulfamoylamino groups; the heterocyclic group is preferably 5 to 7-membered one including 2-furyl, 2-thienyl, 2-pyrimidinyl, 2-benzothiazolyl, 1-pyrrolyl and 1-tetrazolyl groups; the heterocyclic oxy group is preferably one having a 5- to 7-member heterocyclic ring, such as 3,4,5,6-tetrahydropyranyl-2-oxy and 1-phenyltetrazole-5-oxy groups; the heterocyclic thio group is preferably a 5- to 7-membered heterocyclic thio group such as 2-pyridylthio, 2-benzothiazolylthio and 2,4-diphenoxy-1,3,5-triazolo-6-thio groups; the siloxy group includes trimethylsiloxy, triethylsiloxy and dimethylbutylsiloxy groups; the imido group includes succinic acid imido, 3-heptadecylsuccinic acid imido, phthalimido and clutarinido groups; the spiro compound residue includes a spiro[3.3]heptane-1-yl group; the crosslinked hydrocarbon compound residue includes bicyclo-[2.2.1]heptane-1-yl, tricyclo[3.3.1.13 7]decane-1-yl and 7,7-dimethyl-bicyclo[2.2.1]heptane-1-yl groups.

The above groups each may further have a substituent, a non-diffusible group such as a long-chain hydrocarbon group or a polymer residue.

The group represented by $X_2$ capable of splitting upon reaction with an oxidation product of a color developing agent is the same group as defined for the $X_1$ of Formula [I].

In Formula [II], the 6-membered nitrogen-containing heterocyclic ring formed with $Z_2$, is preferably of the 6π electron or 8π electron system. The ring contains at least one —NH—, and preferably further contains >C=O, >C=S, —$SO_2$—. The examples the 6-membered rings include diazines, triazines and tetrazines.

The preferable examples of the cyan coupler of the invention include those represented by the following Formulas [II]-1 to [II]-6:

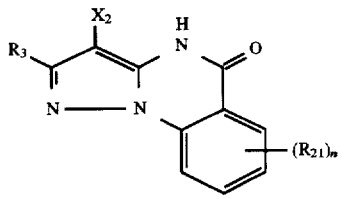

Formula [II]-1

-continued

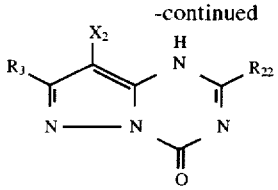

Formula [II]-2

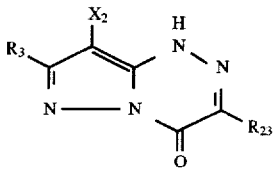

Formula [II]-3

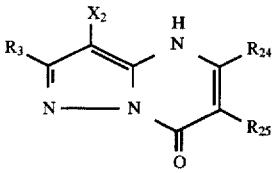

Formula [II]-4

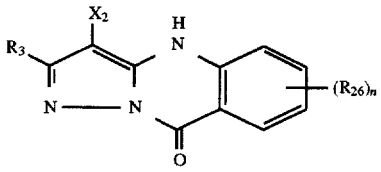

Formula [II]-5

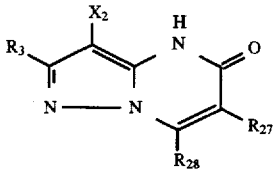

Formula [II]-6 wherein $R_3$, $R_{21}$, $R_{22}$, $R_{23}$, $R_{24}$, $R_{25}$, $R_{26}$, $R_{27}$ and $R_{28}$ are as defined for the $R_1$ of Formula [I]; $X_2$ is as defined for the $X_1$ of Formula [I]. In Formula [II]-1 or [II]-5, n is an integer of 0 to 4, provided that when n is an integer of 2 to 4, the plural number of $R_{21}$s and $R_{26}$s may be either the same or different, respectively.

In Formulas [II]-4 and [II]-6, $R_{24}$, $R_{25}$, $R_{27}$ and $R_{28}$ are as defined for the $R_1$ of Formula [I], but $R_{24}$ and $R_{27}$ each can not be a hydroxyl group.

In Formula [III], $R_4$ and $R_5$ each represent an electron attractive group having a Hammett's substituent constant $\sigma_p$ of not less than 0.20, and the electron attractive group includes the same groups as those represented by the $R_1$ and $R_2$ of Formula [I], provided that the sum of the $\sigma_p$ values of $R_4$ and $R_5$ is not less than 0.65. $X_3$ represents the same group as $X_1$ of Formula [I].

The nitrogen-containing 5-membered heterocyclic ring formed with $Z_3$ is a pyrazole ring, imidazole ring or tetrazole ring, which may have a substituent.

The compounds represented by Formula [III] are classified into those having the following Formulas [III]-1 to [III]-8:

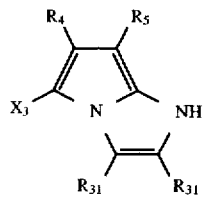

Formula [III]-1

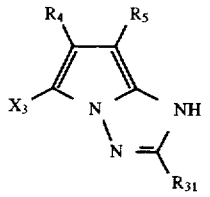

Formula [III]-2

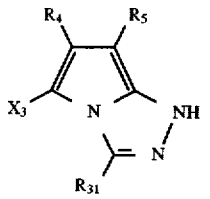

Formula [III]-3

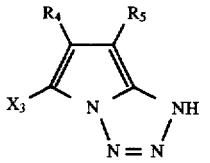

Formula [III]-4

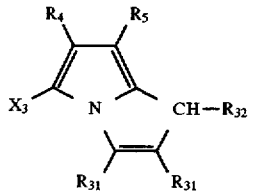

Formula [III]-5

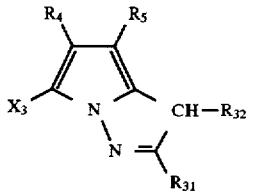

Formula [III]-6

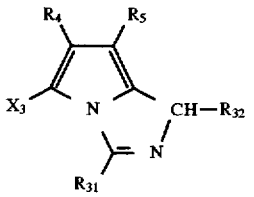

Formula [III]-7

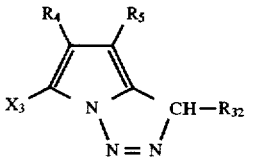

Formula [III]-8 wherein $R_4$, $R_5$ and $X_3$ are as defined in Formula [III]; $R_{31}$ represents a hydrogen atom or a substituent; $R_{32}$ represents an electron attractive group having a Hammett's substituent constant $\sigma_p$ of not less than 0.20.

The substituent represented by $R_{31}$ is as defined for the $R_3$ of Formula [II]; and the electron attractive group represented by $R_{32}$ is the same as those represented by the $R_1$ and $R_2$ of Formula [I].

The preferred as the cyan coupler represented by Formula [III] are those represented by Formulas [III]-1, [III]-2 and [III]-3, and the most preferred is one having Formula [III]-2.

In Formula [IV], $R_6$ and $R_7$ each represent a hydrogen atom or a substituent which is as defined for the $R_3$ of Formula [II]. $X_4$ represents the same group as $X_1$ of Formula [I].

In Formula [IV], $Z_4$ represents a group of non-metallic atoms necessary to form a 6-membered nitrogen-containing heterocyclic ring, provided the heterocyclic ring has at least one dissociation group. As the four divalent linkage groups for constituting the nitrogen-containing 6-membered heterocyclic ring there are, e.g., —NH—, —N(R)—, —N=, —CH(R)—, —CH=, —C(R)=, —CO—, —SO— and —$SO_2$—, wherein R represents a substituent, whose examples include those represented by $R_{31}$. The dissociation group is one having an acidic proton such as —NH—or —CH(R)—, and is preferably one having a pKa value of 3 to 12 in water. The above nitrogen-containing 6-membered heterocyclic ring may have a substituent. The example of $Z_4$ includes a group capable of forming a diazine, triazine or tetrazine ring.

Preferable examples of the coupler represented by Formula [IV] include those having the following Formulas [IV]-1 to [IV]-6.

Formula [IV]-1

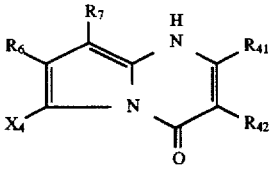

Formula [IV]-2

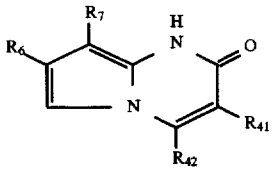

Formula [IV]-3

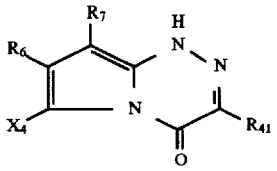

-continued

Formula [IV]-4

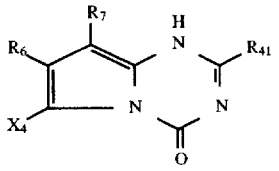

Formula [IV]-5

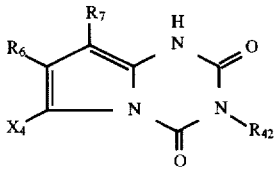

Formula [IV]-6

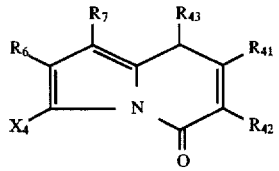

wherein $R_6$, $R_7$ and $X_4$ are as defined in Formula [IV]; $R_{41}$ and $R_{42}$ each represent a hydrogen atom or a substituent; and $R_{43}$ represents an electron attractive group having a Hammett's substituent constant of not less than 0.20;

The examples of the substituent represented by $R_{41}$ or $R_{42}$ are the same as those of the $R_3$ of Formula [II], while the examples of the electron attractive group represented by $R_{43}$ are the same as those of the $R_1$ and $R_2$ of Formula [I].

The examples of the group represented by $X_4$ capable of being released upon reaction with an oxidation product of a color developing agent are the same as those of the $X_1$ of Formula [I].

The following are examples of the cyan coupler (hereinafter referred to as the cyan coupler of the invention) represented by Formulas [I] through, but the invention is not limited thereto.

C-1

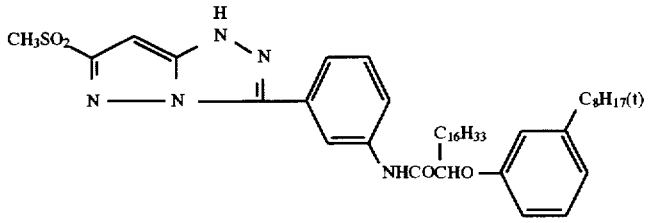

-continued
C-2
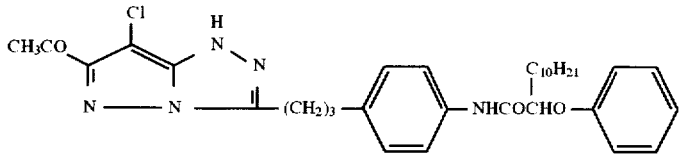
C-3
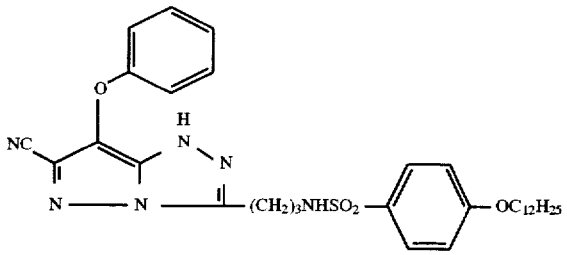
C-4
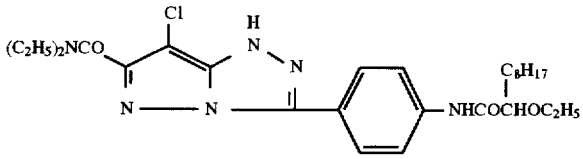
C-5
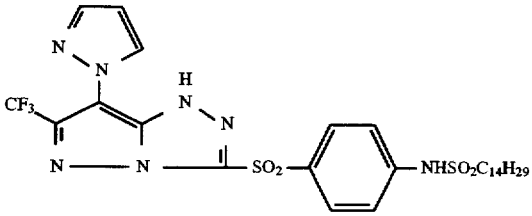
C-6
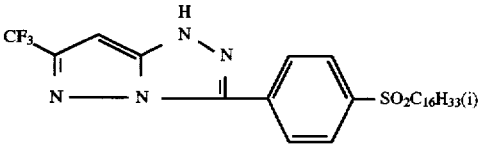
C-7
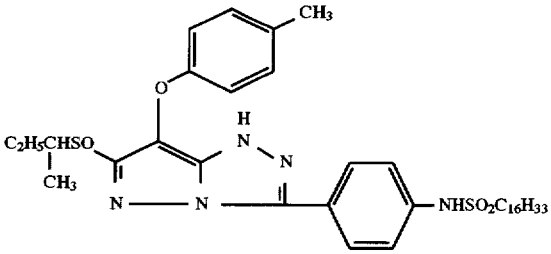
C-8
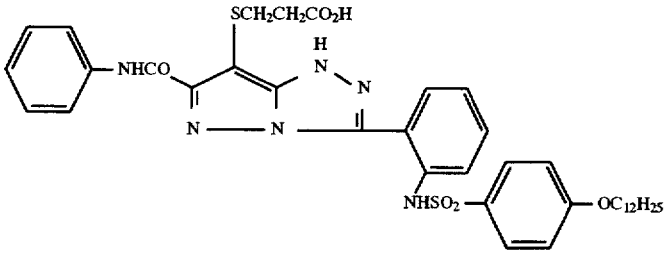

-continued
C-9
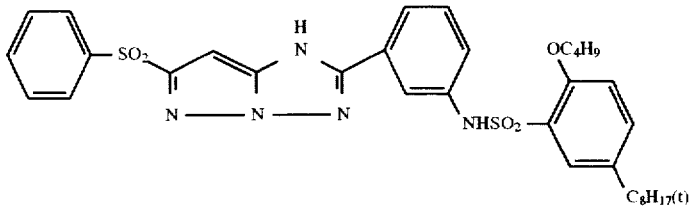
C-10
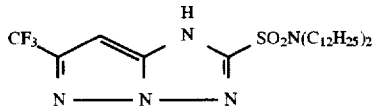
C-11
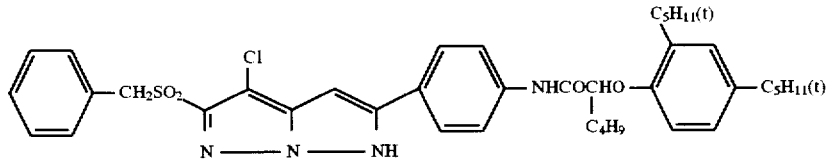
C-12
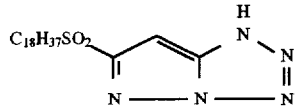
C-13
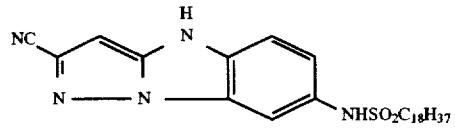
C-14
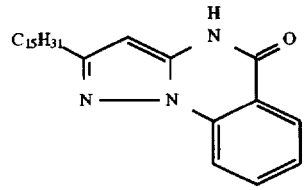
C-15
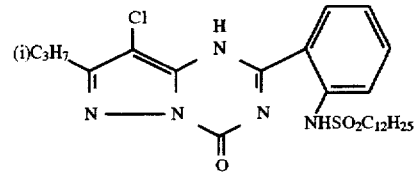
C-16
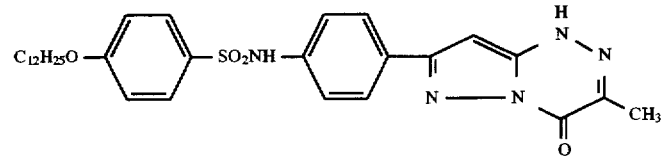
C-17
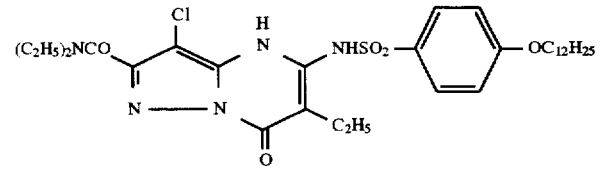

-continued
C-18
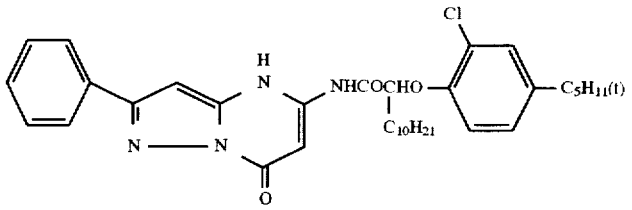
C-19
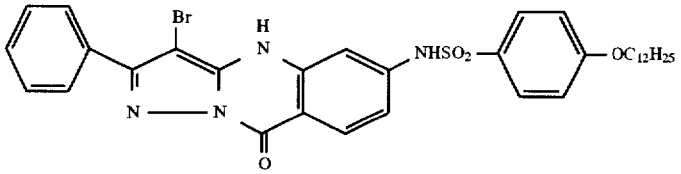
C-20
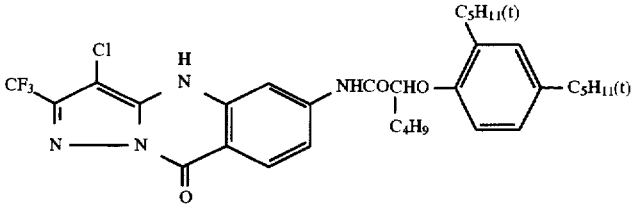
C-21
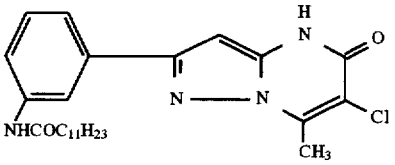
C-22
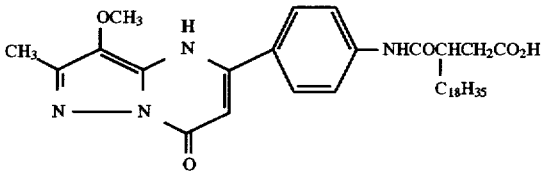
C-23
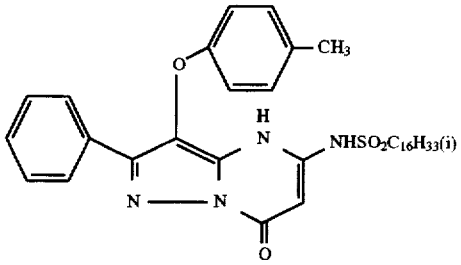
C-24
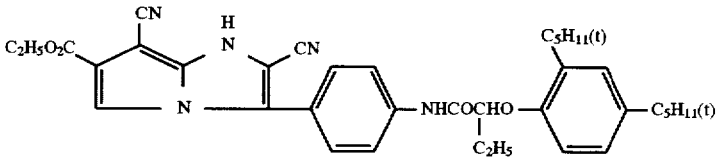

-continued
C-25
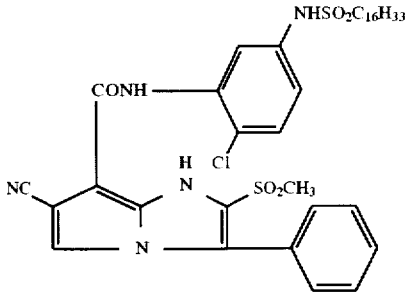
C-26
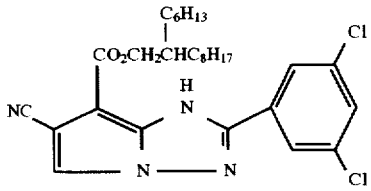
C-27
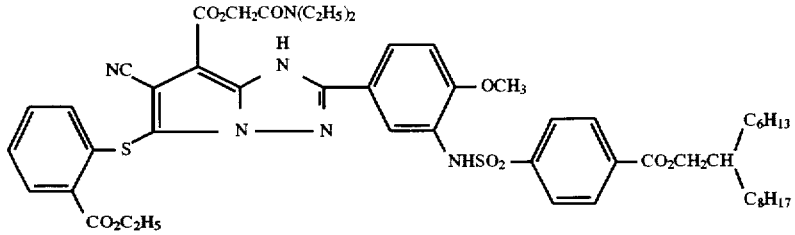
C-28
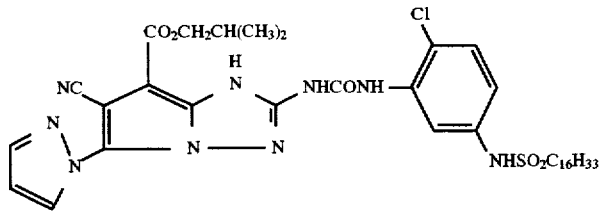
C-29
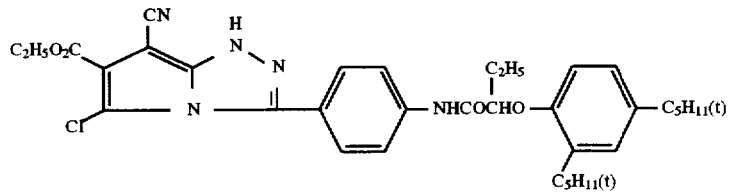
C-30
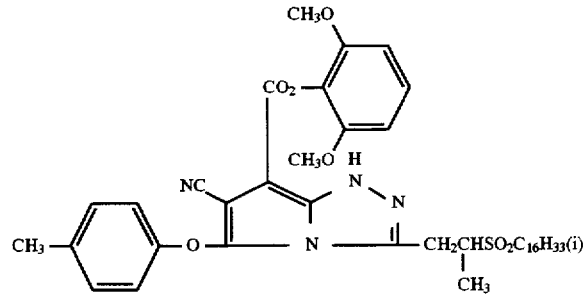
C-31
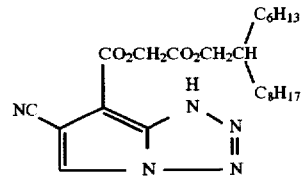

-continued
C-32
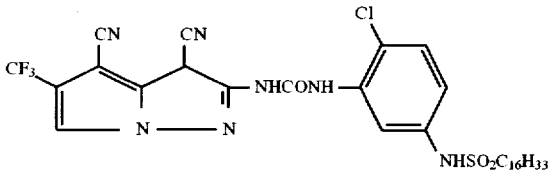
C-33
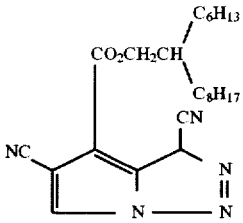
C-34
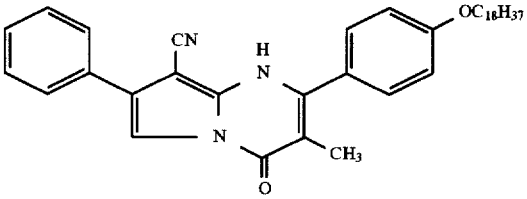
C-35
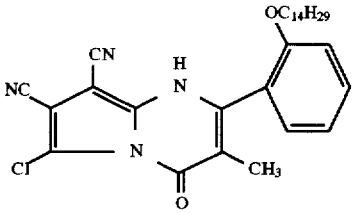
C-36
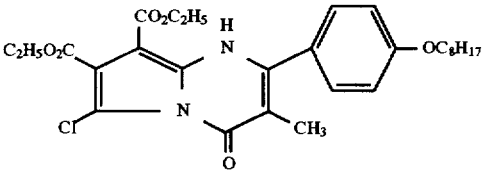
C-37
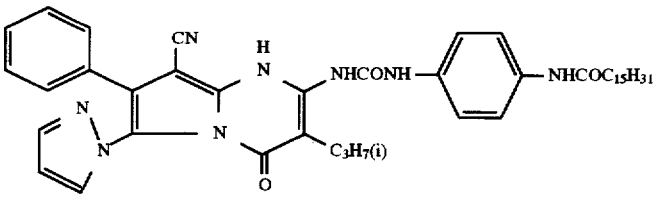
C-38
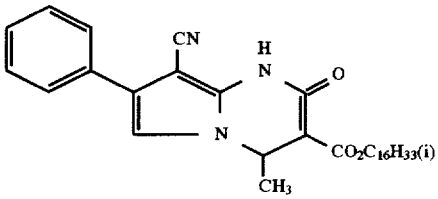
C-39
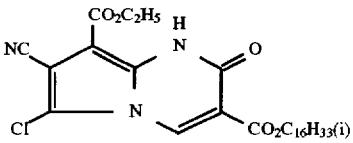

-continued

C-40

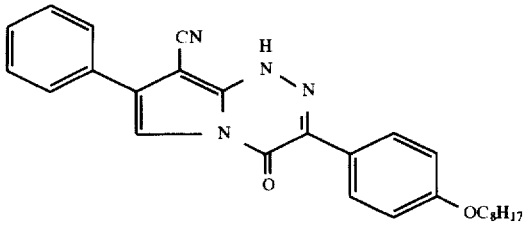

C-41

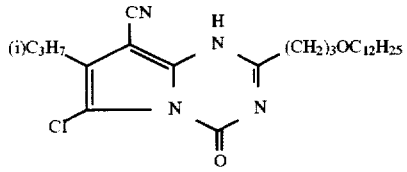

C-42

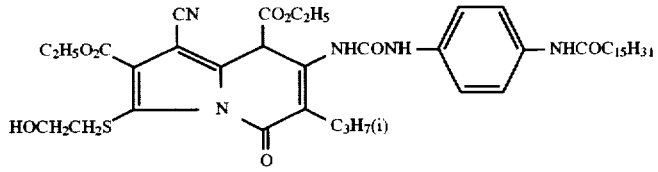

C-43

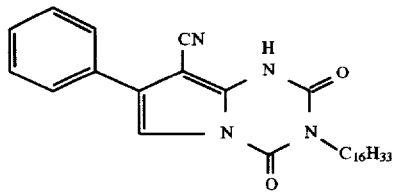

C-44

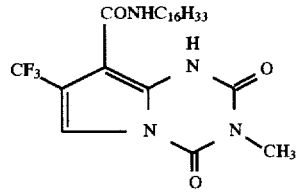

The cyan coupler of the invention can be used in an amount of $1\times10^{-3}$ mol to 1 mol, and preferably $1\times10^{-2}$ to $8\times10^{-1}$ mol per mol of silver halide. The coupler of the invention may be used in combination with different other cyan couplers.

Those methods and techniques for ordinary cyan dye forming couplers may apply to the cyan coupler of the invention as well. Typically, the cyan coupler of the invention is incorporated into a silver halide emulsion, and the emulsion is coated on a support to form the color photographic light sensitive material of the invention.

The coupler used in the silver halide photographic light sensitive material of the invention may be any compound which can produce a coupling product having a spectral absorption maximum of 340 nm or longer on coupling reaction with an oxidation product of a color developing agent. As the typical coupler are known a coupler for forming a yellow dye having a spectral absorption maximum in a wavelength of 350 to 500 nm, a coupler for forming a magenta dye having a spectral absorption maximum in a wavelength of 500 to 600 nm and a coupler (in the invention at least one cyan coupler of the invention is used) for forming a cyan dye having a spectral absorption maximum in a wavelength of 600 to 750 nm.

The yellow coupler used in the invention is a yellow coupler represented by the following Formula (Y-I), (Y-II) or (Y-III):

Formula (Y-I)

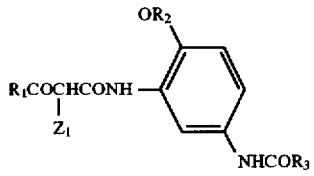

wherein $R_1$ represents an alkyl group or a cycloalkyl group; $R_2$ represents an alkyl group, a cycloalkyl group or an aryl group; $R_3$ represents a substituent; and $Z_1$ represents a hydrogen atom or a group capable of being released upon reaction with an oxidation product of a color developing agent.

Formula (Y-II)

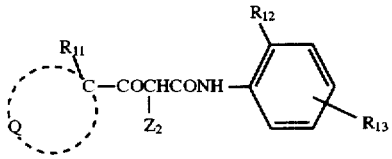

wherein $R_{11}$ represents a monovalent group other than a hydrogen atom; Q represents a 3- to 5-membered hydrocarbon ring with the C or a non-metallic atomic group necessary to form a 3- to 5-membered heterocyclic ring with at least one atom selected from the group consisting of N, S, O and P; $R_{12}$ represents a hydrogen atom, a halogen atom, an alkyl group, an alkoxy group, an aryloxy group or an amino group; a cycloalkyl group or an aryl group; $R_{13}$ represents a substituent; and $Z_2$ represents a hydrogen atom or a group capable of being released upon reaction with an oxidation product of a color developing agent.

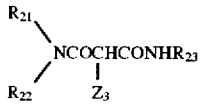

Formula (Y-III)

wherein $R_{21}$ and $R_{22}$ independently represent an alkyl group, an aryl group or a heterocyclic group, provided that $R_{21}$ and $R_{23}$ may combine with each other to form a nitrogen-containing heterocyclic ring together with the N; $R_{23}$ represents an alkyl group, a cycloalkyl group or an aryl group; and $Z_3$ represents a hydrogen atom or a group capable of being released upon reaction with an oxidation product of a color developing agent.

The yellow coupler represented by Formula (Y-I) will be explained below.

In Formula (Y-I), the alkyl group represented by $R_1$ includes a straight-chained or branched alkyl group such methyl, ethyl, i-propyl, t-butyl, dodecyl or 1-hexylnonyl. The cycloalkyl group represented by $R_1$ includes cyclopropyl, cyclohexyl and adamantyl.

The alkyl or cycloalkyl group represented by $R_1$ may have a substituent. The substituent includes a halogen atom (for example, chlorine or bromine), cyano, nitro, an aryl group (for example, phenyl, p-t-octylphenyl, 2,4-di-t-amylhexyl), hydroxyl, an alkoxy group (for example, methoxy or ethoxy), an aryloxy group (for example, phenoxy, 2,4-di-t-amylphenoxy or 4-(hydroxyphenylsulfonyl)phenoxy), a heterocyclicoxy group (for example, 4-pyridyloxy or 2-hexahydropyranyl), a carbonyloxy group (for example, alkylcarbonyloxy such as acetyloxy or pivaloyloxy, arylcarbonyloxy such as benzoyloxy), a sulfonyloxy group (for example, alkylsulfonyloxy such as methanesulfonyloxy, trifluoro methanesulfonyloxy or dodecanesulfonyloxy or arylsulfonyloxy such as benzenesulfonyloxy or p-toluenesulfonyloxy), a carbonyl group (for example, alkylcarbonyl such as acetyl or pyvaloyl, arylcarbonyl such as benzoyl or 3,5-di-t-butyl-4-hydroxybenzoyl), an oxycarbonyl group (for example, alkoxycarbonyl such as methoxycarbonyl, cyclohexyloxycarbonyl or dodecyloxycarbonyl, aryloxycarbonyl such as 2,4-di-t-amylphenoxycarbonyl, heterocyclicoxycarbonyl such as 2-pyridyloxycarbonyl or 1-phenylpyrazolyl-5-oxycarbonyl), a carbamoyl group (for example, alkylcarbamoyl such as dimethylcarbamoyl, 4-(2,4-di-t-amylphenoxybutyl)aminocarbonyl or arylcarbamoyl such as phenylcarbamoyl or 1-naphthylcarbamoyl), a sulfonyl group (for example, alkylsulfonyl such as methanesulfonyl or trifluoro methanesulfonyl or arylsulfonyl such as p-toluenesulfonyl), a sulfamoyl group (for example, alkylsulfamoyl dimethylsulfamoyl or 4-(2,4-di-t-amylphenoxybutyl)aminosulfonyl, arylsulfamoyl such as phenylsulfamoyl, or acylsulfamoyl such as acetylsulfamoyl or ethylcarbonylaminosulfamoyl), an amino group (for example, alkylamino such as dimethylamino, cyclohexylamino, or dodecylamino), a sulfonamido group (for example, alkylsulfonamido such as methanesulfonamido, heptafluoroprapanesulfonamido or hexanedecylsulfonamido or arylsulfonamido such as p-toluenesulfonamido or pentafluorobenzenesulfonamido), an acylamino group (for example, alkylamino such as dimethylamino, cyclohexylamino or dodecylamino, arylamino such as anilino, p-t-octylanilino), an alkylthio group (for example, methylthio or octylthio), an arylthio group (for example, phenylthio), a heterocyclicthio group (for example, 1-phenyltetrazole-5-thio or 5-methyl-1,3,4-oxadiazole-2-thio).

$R_1$ represents preferably an alkyl group, more preferably a branched alkyl group, and especially preferably a t-butyl group.

The alkyl or cycloalkyl group represented by $R_2$ includes the same as the alkyl or cycloalkyl group represented by $R_1$. The aryl group represented by $R_2$ includes a phenyl or naphthyl group. The alkyl, cycloalkyl or aryl group represented by $R_2$ may have a substituent. The substituent includes the same as the alkyl or cycloalkyl group represented by $R_1$ or the substituent denoted above in the alkyl or cycloalkyl group represented by $R_1$.

$R_2$ represents preferably an alkyl group, more preferably an unsubstituted alkyl group, and especially preferably a methyl group.

The group represented by $Z_1$, which is capable of being released upon reaction with an oxidation product of a color developing agent, includes a nitrogen-containing heterocyclic group capable of coupling at the coupling position through its nitrogen atom, an aryloxy group, an arylthio group, a heterocyclicoxy group, an acyloxy group, a carbamoyloxy group, an alkylthio group and a halogen atom.

The nitrogen-containing heterocyclic group represented by $Z_1$, which is capable of coupling at the coupling position through its nitrogen atom, has 1–15, preferably 1–10 carbon atoms. The nitrogen-containing heterocyclic group preferably represents a 5–6 membered, substituted or unsubstituted, saturated or unsaturated heterocyclic group or a single or condensed heterocyclic group. The heterocyclic group may contain, as a hetero atom, an oxygen or sulfur atom, in addition to a nitrogen atom. The preferable example of the heterocyclic group includes a 1-pyrazolyl, 1-imidazolyl, pyrrolyno, 1,2,3-triazole-2-yl, 1,2,3-triazole-1-yl, benzotriazolyl, benzimidazolyl, imidazolidine-2,4-dione-3-yl, 1, oxazolidine-2,4-dione-3-yl, 1,2,3-triazolidine-3,5-dione-4-yl, imidazolidine-2,4,5-trione-3-yl, 2-imidazolinone-1-yl, 3,5-dioxomorpholino and 1-indazolyl. When the heterocyclic group has a substituent, the substituent is not limited but preferably represents an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, a cyano group or a sulfonyl group.

The aryloxy group represented by $Z_1$ represents a substituted or unsubstituted aryloxy group having preferably 6–10 carbon atoms, and more preferably a substituted or unsubstituted phenoxy group. When the aryloxy group has a substituent, at least one substituent preferably represents an electron attractive group such as a sulfonyl group, an alkoxycarbonyl group, a sulfamoyl group, a halogen atom, a carbamoyl group, a nitro group, a cyano group or an acyl group.

The arylthio group represented by $Z_1$ represents a substituted or unsubstituted arylthio group having preferably 6–10 carbon atoms, and more preferably a substituted or unsubstituted phenylthio group. When the arylthio group has a substituent, at least one substituent preferably represents an alkyl group, an alkoxy group, a sulfonyl group, an alkoxycarbonyl group, a sulfamoyl group, a halogen atom, a carbamoyl group, or a nitro group.

The heterocyclicoxy group represented by $Z_1$ represents a heterocyclicoxy group having 1–20 carbon atoms, and 1–10 carbon atoms, which includes a 3–12, preferably 5–6 membered, substituted or unsubstituted, saturated or unsaturated heterocyclic group or a single or condensed heterocyclic group, each containing at least one of a nitrogen atom, an oxygen atom and a sulfur atom as a hetero atom. The heterocyclicoxy group includes pyridyloxy, pyrazolyloxy and furyloxy. When the heterocyclicoxy group has a substituent, at least one substituent preferably represents an aikyl group, an aryl group, a carboxy group, an alkoxy group, a halogen atom, an alkoxycarbonyl group, an aryloxycarbonyl group, an alkylthio group, an acylamino group, a sulfonamide group, a nitro group, a carbamoyl group or a sulfonyl group.

The heterocyclic group of the heterocyclicthio group represented by $Z_1$ represents a 3- to 12-, preferably 5- or 6-membered, substituted or unsubstituted, saturated or unsaturated, single or condensed heterocyclic group having 1–20 carbon atoms, and preferably 1–10 carbon atoms and containing, as a hetero atom, at least one selected from the group consisting of a nitrogen, oxygen and sulfur atom. The heterocyclicthio group includes tetrazolylthio, 1,3,4-thiadiazolylthio, 1,3,4-oxadiazolylthio, 1,3,4-triazolylthio, benzimidazolylthio, benzothiazolylthio and 2-pyridylthio. When the heterocyclicthio group has a substituent, at least one substituent preferably represents an alkyl group, an aryl group, a carboxy group, an alkoxy group, a halogen atom, an alkoxycarbonyl group, an aryloxycarbonyl group, an alkylthio group, an acylamino group, a sulfonamide group, a nitro group, a carbamoyl group, a heterocyclic group or a sulfonyl group.

The acyloxy group represented by $Z_1$ represents a single or condensed ring having preferably 6–10 carbon atoms. The acyloxy group represents a substituted or unsubstituted aromatic acyloxy group or a substituted or unsubstituted aliphatic acyloxy group having 2–30, preferably 2–20 carbon atoms. The acyloxy group may further have a substituent.

The carbamoyloxy group represented by $Z_1$ represents a carbamoyloxy group containing an aliphatic group of 1–30, preferably 1–20 carbon atoms, an aryl group or a heterocyclic group or a substituted or unsubstituted carbamoyloxy group. The carbamoyloxy group includes N,N-diethylcarbamoyloxy, N-phenylcarbamoyloxy, 1-imidazolylcarbonyloxy and 1-pyrrolocarbonyloxy.

The alkylthio group represented by $Z_1$ represents a straight-chained or branched, saturated or unsaturated, substituted or unsubstituted alkylthio group having 1–30, preferably 1–20 carbon atoms. The alkylthio group may further have a substituent.

The preferred $Z_1$ is a group represented by the following Formula (I), (II), (III):

$-OR_4$ Formula (I)

$-OCOR_4$ Formula (II)

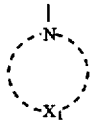

Formula (III)

In Formula (I) or (II), $R_4$ represents an alkyl group, a cycloalkyl group, an aryl group or a heterocyclic group. The alkyl group, a cycloalkyl group or an aryl group represented by $R_4$ is the same as the alkyl, cycloalkyl or aryl group denoted in $R_2$ of Formula (Y-I). The heterocyclic group represented by $R_4$ includes 4-pyridyl and 2-hexahydropyranyl. The alkyl group, a cycloalkyl group or an aryl group represented by $R_4$ may have a substituent. The substituent includes the same as the substituent of the alkyl, cycloalkyl or aryl group represented by $R_2$ of Formula (Y-I) denoted above.

Of the alkyl, cycloalkyl aryl or heterocyclic group represented by $R_4$, the aryl group is preferable. The substituent of $R_4$ preferably represents an electron attractive group, for example, oxycarbonyl such as carboxyl, methoxycarbonyl or i-propyloxycarbonyl, acyl such as acetyl or benzoyl, sulfonyl group such as trifluoromethanesulfonyl or 4-hydroxyphenyosulfonyl, nitro, cyano, halogen, sulfamoyl such as dimethylsulfamoyl, acylamino such as acetylamino or pentafluorobenzoyl or sulfonamido such as methanesulfonamido.

In Formula (III), $X_1$ represents a non-metallic atomic group necessary to form a 5- or 6-membered ring together with a nitrogen atom. An atomic group necessary to form the non-metallic atomic group includes methylene, methine, substituted methine-CO—, —N($R_5$)— in which $R_5$ represents a hydrogen atom, an alkyl group, an aryl group or a heterocyclic group, —N=, —O— or —S(O)$_u$— in which u represents an integer of 0 to 2.

The especially preferred $Z_1$ is a group represented by the following Formula (IV):

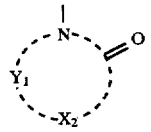

In Formula (IV), $Y_1$ represents —N($R_6$) in which $R_6$ represents the same as the group represented by $R_5$ of Formula (III), —O—, —S(O)$_r$— in which r represents an integer of 0 to 2, —C(O)—, —C($R_7$)($R_8$)— in which $R_7$ and $R_8$ independently represent a hydrogen atom or the same group as the substituent of the alkyl, cycloalkyl or aryl group represented by $R_2$ of Formula (Y-I), or —C($R_9$)— in which $R_9$ represents a hydrogen atom or the same group as the substituent of the alkyl, cycloalkyl or aryl group represented by $R_2$ of Formula (Y-I).

$X_2$ represents a non-metallic atomic group necessary to form a 5- or 6-membered ring together with —$Y_1$—N—CO—. An atomic group necessary to form the non-metallic atomic group includes the same as the atomic group represented by $X_1$ of Formula (III).

$R_3$ represents a substituent, preferably an unsubstituted alkyl group having 11 to 21 carbon atoms, and more preferably a straight-chained alkyl group.

The two-equivalent yellow coupler represented by Formula (Y-I) can form a dimer, trimer or tetramer or polymer in which two or more of the coupler combine with each other through the substituent of the coupler.

The yellow coupler represented by Formula (Y-I) can be easily synthesized from starting materials commercially available according to a conventional method disclosed in Japanese Patent O.P.I. Publication Nos. 63-123047/1988, 4-9051/1992 and 4-124661/1992.

The example of the yellow coupler represented by Formula (Y-I) will be shown below, but is not limited thereto.

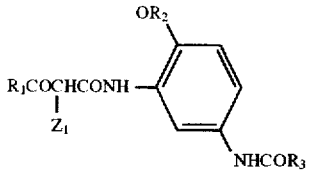
| No | $R_1$ | $R_2$ | $R_3$ | $Z_1$ |
|---|---|---|---|---|
| I-1 | t-$C_4H_9$ | $CH_3$ | $C_{17}H_{35}$ | 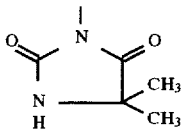 |
| I-2 | t-$C_4H_9$ | $CH_3$ | $C_{11}H_{23}$ | 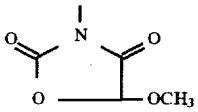 |
| I-3 | t-$C_4H_9$ | $CH_3$ | $C_{13}H_{27}$ | 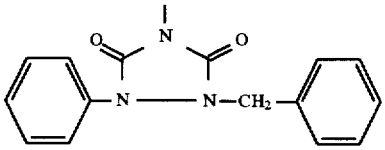 |
| I-4 | t-$C_4H_9$ | $CH_3$ | $C_{13}H_{27}$ | 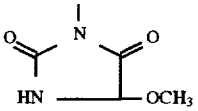 |
| I-5 | t-$C_4H_9$ | $CH_3$ | $C_{15}H_{31}$ | 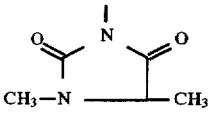 |
| I-6 | t-$C_4H_9$ | $CH_3$ | $C_{15}H_{31}$ | 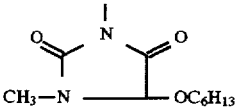 |
| I-7 | t-$C_4H_9$ | $CH_3$ | $C_{17}H_{35}$ | 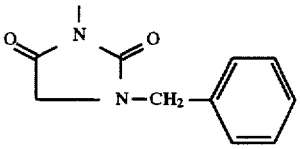 |
| I-8 | t-$C_4H_9$ | $CH_3$ | $C_{17}H_{35}$ | 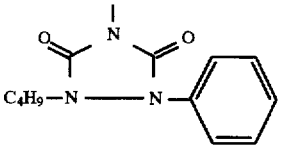 |
| I-9 | t-$C_4H_9$ | $CH_3$ | $C_{19}H_{39}$ | 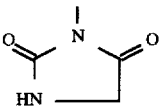 |
| I-10 | t-$C_4H_9$ | $CH_3$ | $C_{15}H_{31}$ | 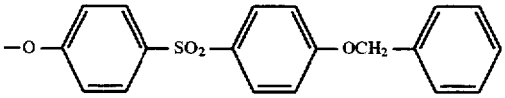 |

-continued

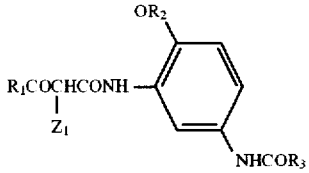

| No | $R_1$ | $R_2$ | $R_3$ | $Z_1$ |
|---|---|---|---|---|
| I-11 | t-$C_4H_9$ | $C_{16}H_{33}$ | $C_{15}H_{31}$ | 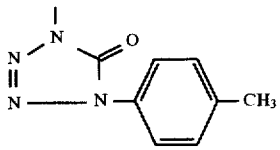 |
| I-12 | t-$C_4H_9$ | $CH_2COOC_{12}H_{25}$ | $C_{15}H_{31}$ | 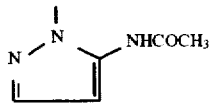 |
| I-13 | t-$C_4H_9$ | 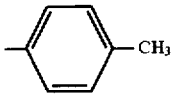 | $C_{17}H_{31}$ | 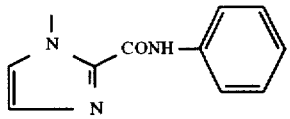 |
| I-14 | t-$C_4H_9$ | $CH_3$ | $C_{17}H_{31}$ | 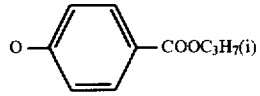 |
| I-15 | 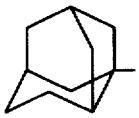 | $CH_3$ | $C_{13}H_{27}$ | 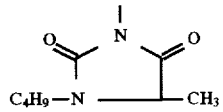 |

The yellow coupler represented by Formula (Y-II) will be explained below.

In Formula (Y-II), $R_{11}$ preferably represents a halogen atom, a cyano group, or an aliphatic group of 1 to 30 carbon atoms (for example, alkyl, alkoxy) or an aromatic group of 6 to 30 carbon atoms (for example, aryl or aryloxy), each of which may have a substituent. The substituent includes halogen, alkyl, alkoxy, nitro, amino, acylamino, sulfonamido and acyl.

In Formula (Y-II), Q preferably represents a non-metallic atomic group necessary to form a substituted or unsubstituted, 3- to 5-membered hydrocarbon ring of 3–30 carbon atoms with the C or a substituted or unsubstituted, 3- to 5-membered heterocyclic ring of 3–30 carbon atoms containing a hetero atom selected from the group consisting of N, S, O and P. The ring which Q forms with the C may have an unsaturated bond. The ring which Q forms with the C includes a cyclopropane, cyclobutane, cyclopentane, cyclopropene, cyclobutene, cyclopentene, oxetane, oxolane, 1,3-dioxolane, thiethane, thielane and pyrrolidine ring. The substituent includes halogen, hydroxyl, alkyl, aryl, acyl, alkoxy, aryloxy, cyano, alkoxycarbonyl, alkylthio and arylthio group.

$R_{12}$ preferably represents a halogen atom or an alkoxy group of 1 to 30 carbon atoms, an aryloxy group of 6 to 30 carbon atoms, an alkyl group of 1 to 30 carbon atoms or an amino group of 0 to 30 carbon atoms, each of which may have a substituent. The substituent includes halogen, alkyl, alkoxy, and aryloxy.

$R_{13}$ preferably represents a halogen atom or an alkyl group of 1 to 30 carbon atoms, an aryl group of 6 to 30 carbon atoms, an alkoxy group of 1 to 30 carbon atoms, an alkoxycarbonyl group of 2 to 30 carbon atoms, an aryloxycarbonyl group of 7 to 30 carbon atoms, an acylamino group of 1 to 30 carbon atoms, a sulfonamido group of 1 to 30 carbon atoms, a carbamoyl group of 1 to 30 carbon atoms, a sulfamoyl group of 0 to 30 carbon atoms, an alkylsulfonyl group of 1 to 30 carbon atoms, an arylsulfonyl group of 6 to 30 carbon atoms, a ureido group of 1 to 30 carbon atoms, a sulfamoylamino group of 0 to 30 carbon atoms, an alkoxycarbonylamino group of 2 to 30 carbon atoms, a heterocyclic group of 1 to 30 carbon atoms, an acyl group of 1 to 30 carbon atoms, an alkylsulfonyloxy group of 1 to 30 carbon atoms or an arylsulfonyloxy group of 6 to 30 carbon atoms, each of which may have a substituent. The substituent includes halogen, alkyl, aryl, heterocyclic, alkoxy, aryloxy, heterocyclicoxy, alkylthio, arylthio, heterocyclicthio, alkylsulfonyl, arylsulfonyl, acyl, acylamino, sulfonamide, carbamoyl, sulfamoyl, alkoxycarbonylamino, sulfamoylamino, ureido, cyano, nitro, acyloxy, alkoxycarbonyl, aryloxycarbonyl, alkylsulfonyloxy, arylsulfonyloxy and aryloxy.

The position of $R_{13}$ is preferably at a meta or para position, on the benzene ring of the anilide, to the group.

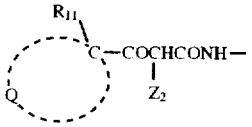

$Z_2$ represents the same as $Z_1$ in Formula (Y-I)

In formula (Y-II), an especially preferable substituent will be explained below.

$R_{11}$ especially preferably represents a halogen atom or an alkyl group, and most preferably a methyl group. Q especially preferably represents a non-metallic atomic group necessary to form a 3- to 5-membered hydrocarbon ring with the C, for example,

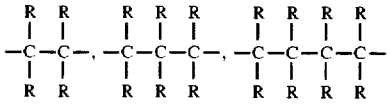

wherein R represents a hydrogen atom, a halogen atom or an alkyl group, provided that plural Rs may be the same or different. Q most preferably represents

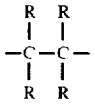

which forms a 3-membered ring with the C.

$R_{12}$ especially preferably represents a chlorine atom, a fluorine atom, an alkyl group of 1–6 carbon atoms (for example, methyl, trifluoromethyl, ethyl, i-propyl, t-butyl), an alkoxy group of 1–8 carbon atoms (for example, methoxy, ethoxy, methoxyethoxy, butoxy), or an aryloxy group of 6–24 carbon atoms (for example, phenoxy, p-tolyloxy, p-methoxyphenoxy), and most preferably a chlorine atom, a methoxy group or a trifluoromethyl group.

$R_{13}$ especially preferably represents a halogen atom, an alkoxy group, an alkoxycarbonyl group, an aryloxycarbonyl group, an acylamino group, a sulfonamido group, a carbamoyl group or a sulfamoyl group, and most preferably an alkoxy group, an alkoxycarbonyl group, an acylamino group, or a sulfonamido group.

$Z_2$ especially represents a group represented by Formula (IV) denoted in Formula (Y-I).

The yellow coupler represented by Formula (Y-II) can be easily synthesized from starting materials commercially available according to a conventional method disclosed in Japanese Patent O.P.I. Publication No. 4-218042/1992.

The example of the yellow coupler represented by Formula (Y-II) will be shown below, but is not limited thereto.

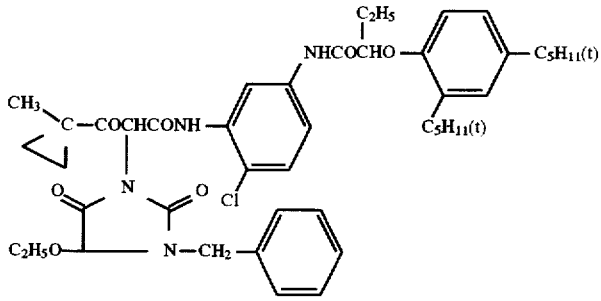

II-1

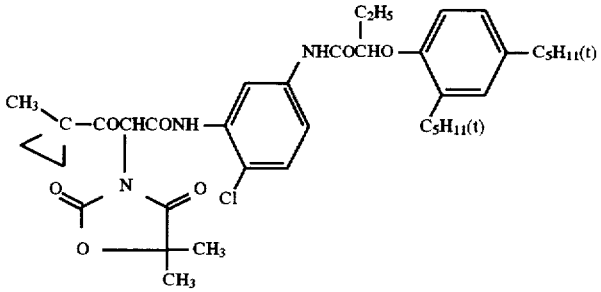

II-2

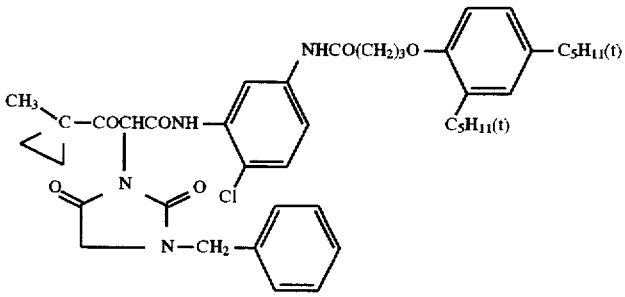

II-3

-continued
II-4
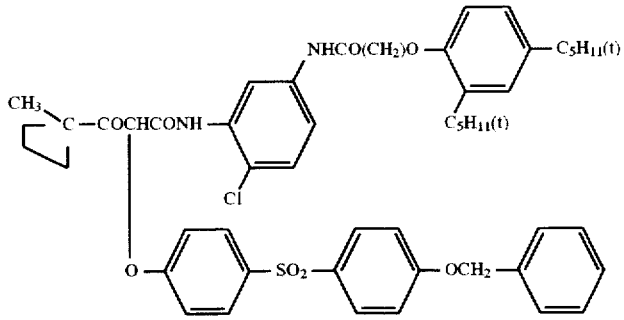
II-5
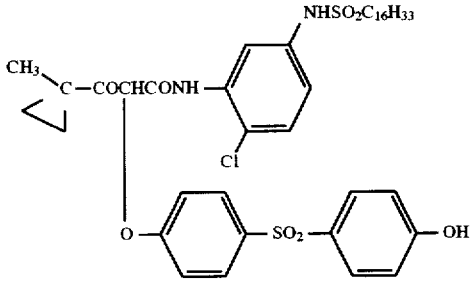
II-6
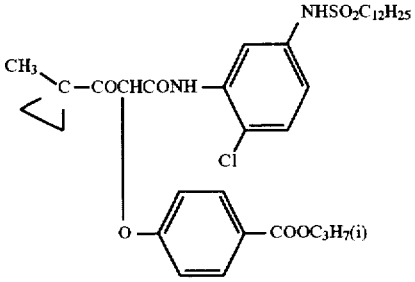
II-7
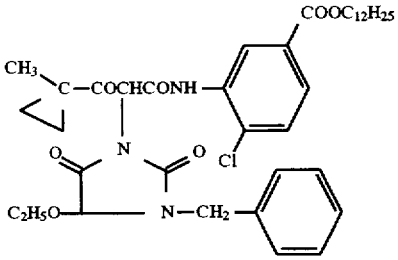
II-8
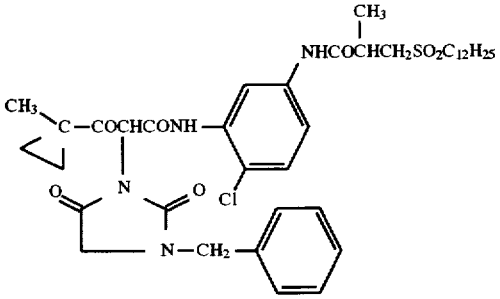
II-9
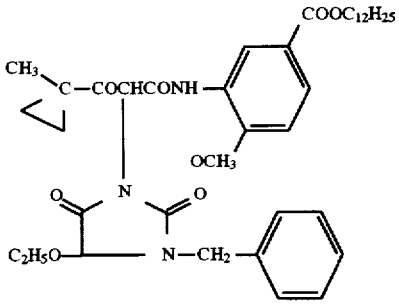
II-10
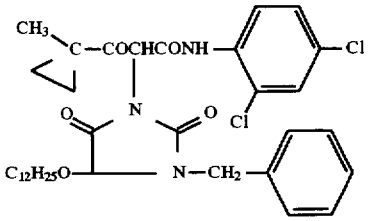
II-11
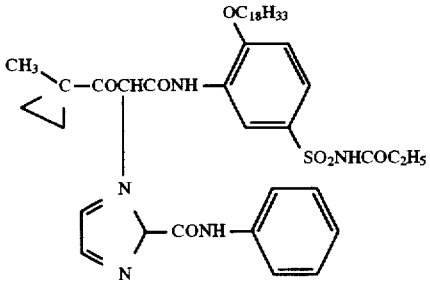
II-12
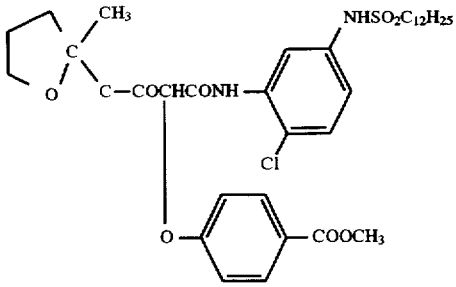

-continued

II-13

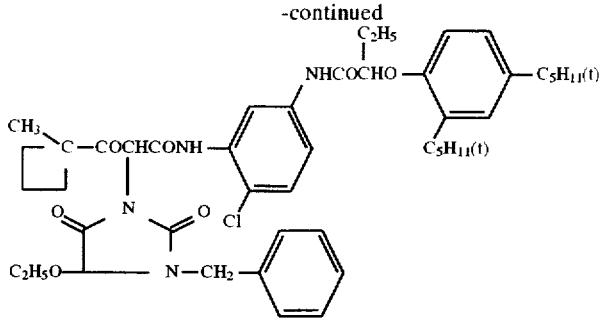

II-14

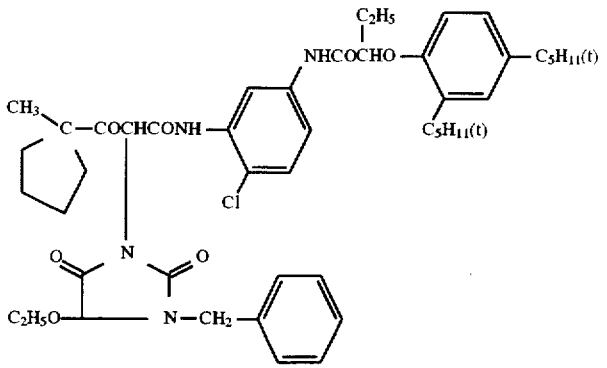

II-15

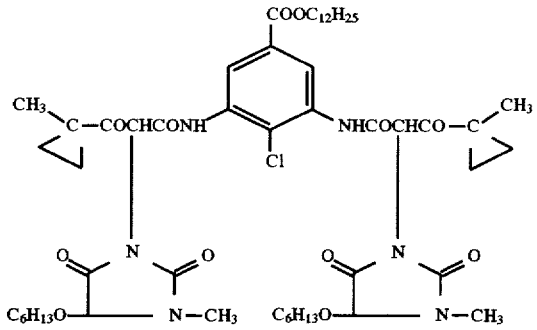

II-16

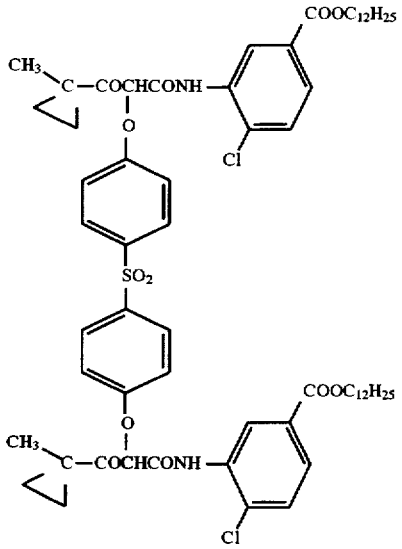

II-17

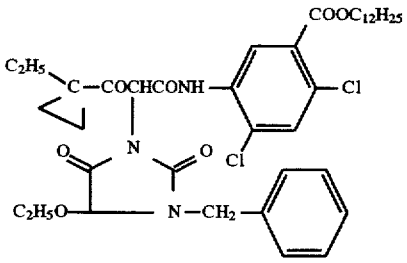

The coupler represented by Formula (Y-III) will be explained below.

The alkyl group represented by $R_{21}$ or $R_{22}$ represents a straight-chained, branched or cyclic, saturated or unsaturated, substituted or unsubstituted alkyl group having 1 to 30, preferably 1 to 20 carbon atoms. The example includes methyl, ethyl, propyl, butyl, cyclopropyl, allyl, t-octyl, i-butyl, dodecyl and 2-hexyldecyl.

The heterocyclic group represented by $R_{21}$ or $R_{22}$ represents a 3 to 12-, preferably 5 to 6-membered, substituted or unsubstituted, saturated or unsaturated, single or condensed heterocyclic group having 1–20 carbon atoms, and preferably 1–10 carbon atoms and containing, as a hetero atom, at least one selected from the group consisting of a nitrogen, oxygen and sulfur atom. The example of the heterocyclicthio group includes 3-pyrrolidinyl, 1,2,4-triazole-3-yl, 2-pyridyl, 4-pyrimidinyl, 3-pyrazolyl, 2-pyrrolyl, 2,4-dioxo-1,3-imidazolidine-5-yl and pyranyl.

The aryl group represented by $R_{21}$ or $R_{22}$ represents an aryl group having 6–20, preferably 6–10 carbon atoms. The example of the aryl group includes phenyl and naphthyl.

The nitrogen-containing heterocyclic group in which $R_{21}$ and $R_{22}$ combine with each other represents a 3- through 12-, preferably 5- or 6-membered, substituted or unsubstituted, saturated or unsaturated, single or condensed heterocyclic group having 1 to 20, preferably 1 to 15 carbon atoms, which may contain an oxygen or sulfur atom in addition to a nitrogen atom. The example of the heterocyclic group includes pyrrolidino, piperidino, morpholino, 1-pyperadinyl, 1-indolinyl, 1,2,3,4-tetrahydroquinoline-1-yl, 1-imidazolidinyl, 1-pyrazolyl, 1-pyrrolinyl, 1-pyrazolinyl, 2,3-dihydro-1-indazolyl, 2-isoindolinyl, 1-indolyl, 1-pyrrolyl, 4-thiazine-S,S-dioxo-4-yl and benzoxazine-4-yl.

The alkyl, aryl or heterocyclic group represented by $R_{21}$ or $R_{22}$ or the nitrogen-containing heterocyclic group in which $R_{21}$ and $R_{22}$ combine with each other may have a substituent. The substituent includes halogen (for example, fluorine, chlorine), alkoxycarbonyl of 2–30, preferably 2–20 carbon atoms (for example, methoxycarbonyl, dodecyloxycarbonyl, hexadecyloxycarbonyl), acylamino of 2–30, preferably 2–20 carbon atoms (for example, acetoamido, tetradecanamido, 2-(2,4-di-t-amylphenoxy) butanamido, benzamido), sulfonamido of 1–30, preferably 1–20 carbon atoms (for example, methanesulfonamido, dodecanesulfonamido, hexadecanesulfonamido, benzenesulfonamido), carbamoyl of 1–30, preferably 1–20 carbon atoms (for example, N-butylcarbamoyl, N,N-diethylcarbamoyl), N-sulfonylcarbamoyl of 1–30, preferably 1–20 carbon atoms (for example, N-mesylcarbamoyl, N-dodecylsulfonylcarbamoyl), sulfamoyl of 1–30, preferably 1–20 carbon atoms (for example, N-butylsulfamoyl, N-dodecylsulfamoyl, N-hexadecylsulfamoyl, N-3-(2,4-di-t-amylphenoxy)butylsulfamoyl, N,N-diethylsulfamoyl), alkoxy of 1–30, preferably 1–20 carbon atoms (for example, methoxy, hexadecyloxy, i-propoxy), aryloxy of 6–20, preferably 6–10 carbon atoms (for example, phenoxy, 4-methoxyphenoxy, 3-t-butyl-4-hydroxyphenoxy, naphthoxy), aryloxycarbonyl of 7–21, preferably 7–11 carbon atoms (for example, phenoxycarbonyl), N-acylsulfamoyl of 2–30, preferably 2–20 carbon atoms (for example, N-propanoylsulfamoyl, N-tetradecanoylsulfamoyl), sulfonyl of 1–30, preferably 1–20 carbon atoms (for example, methanesulfonyl, octanesulfonyl, 4-hydroxyphenylsulfonyl, dodecanesulfonyl), alkoxycarbonylamino of 1–30, preferably 1–20 carbon atoms (for example, ethoxycarbonylamino), cyano, nitro, carboxy, sulfo, alkylthio of 1–30, preferably 1–20 carbon atoms (for example, methylthio, dodecylthio, dodecylcarbamoylmethylthio), ureido of 1–30, preferably 1–20 carbon atoms (for example, N-phenylureido, N-hexylureido), aryl of 6–20, preferably 6–10 carbon atoms (for example, phenyl, naphthyl, 4-methoxyphenyl), heterocyclic of 1–20, preferably 1–10 carbon atoms (for example, a 3- through 12-, preferably 5- or 6-membered, substituted or unsubstituted, saturated or unsaturated, single or condensed heterocyclic group such as 2-pyridyl, 3-pyrazolyl, 1-pyrrolyl, 2,4-dioxo-1,3-imidazolidine-1-yl, 2-benzoxazolyl, morpholino, indolyl), a straight-chained, branched or cyclic, saturated or unsaturated, alkyl of 1 to 30, preferably 1 to 20 carbon atoms (for example, methyl, ethyl, i-propyl, cyclopropyl, t-pentyl, t-octyl, cyclopentyl, t-butyl, sec-butyl, dodecyl, 2-hexyldecyl), acyl of 1 to 30, preferably 2 to 20 carbon atoms (for example, acetyl, benzoyl), acyloxy of 2 to 30, preferably 2 to 20 carbon atoms (for example, propanoyloxy, tetradecanoyloxy), arylthio of 6 to 20, preferably 6 to 10 carbon atoms (for example, phenylthio, naphthylthio), sulfamoylamino of 0 to 30, preferably O to 20 carbon atoms (for example, N-butylsulfamoylamino, N-dodecylsulfamoylamino, N-phenylsulfamoylamino), and N-sulfonylsulfamoylamino of 1 to 30, preferably 1 to 20 carbon atoms (for example, N-mesylsulfamoylamino, N-ethanesulfonylsulfamoylamino, N-dodecanesulfonylsulfamoylamino, N-hexanesulfonylsulfamoylamino).

The above substituent may further have a substituent, which includes the above described group.

The preferable substituent is alkoxy, halogen, alkoxycarbonyl, acyloxy, acylamino, sulfonyl, carbamoyl, sulfamoyl, sulfonamido, nitro, alkyl or aryl.

The aryl group represented by $R_{23}$ in Formula (Y-III) represents a substituted or unsubstituted aryl group having 6–20, preferably 6–10 carbon atoms. The example includes phenyl or naphthyl.

The heterocyclic group represented by $R_{23}$ in Formula (Y-III) represents the same as the heterocyclic group represented by $R_{21}$ or $R_{22}$ described above.

The aryl or heterocyclic group represented by $R_{23}$ may have a substituent. The substituent includes that denoted above in $R_{21}$. The substituent of $R_{23}$ preferably represents halogen, alkoxycarbonyl, sulfamoyl, carbamoyl, sulfonyl, N-sulfonylsulfamoyl, N-acylsulfamoyl, alkoxy, acylamino, N-sulfonylcarbamoyl, sulfonamido, and alkyl.

The especially preferable $R_{23}$ is a phenyl group having at least one substituent in an ortho position.

The group represented by $Z_3$ in Formula (Y-III) represents the same as the group denoted above in $Z_1$ of Formula (Y-I), and preferably the group represented by Formula (IV).

The especially preferable coupler represented by Formula (Y-III) will be explained below.

The group represented by $R_{21}$ in Formula (Y-III) represents preferably an alkyl group, and especially preferably an alkyl group having 1 to 10 carbon atoms.

The group represented by $R_{23}$ in Formula (Y-III) represents preferably an aromatic group, and especially preferably a phenyl group having at least one substituent in an ortho position. The substituent or preferable substituent $R_{23}$ may have is the same as the substituent denoted above in the aryl group of $R_{23}$.

The group represented by $Z_3$ in Formula (Y-III) represents preferably a 5 or 6-membered nitrogen-containing heterocyclic group combining with a coupling position through a nitrogen atom, an aryloxy group, a 5 or 6-membered heterocyclicoxy group or a 5 or 6-membered heterocyclicthio group.

Of the couplers represented by Formula (Y-III), the especially preferable is a coupler represented by the following Formula (Y-IIIa), (Y-IIIb) or (Y-IIIc):

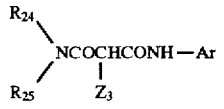

Formula (Y-IIIa)

-continued

Formula (Y-IIIb)

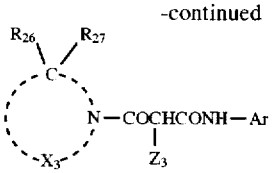

Formula (Y-IIIc)

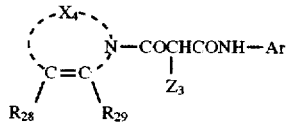

In Formula above, $Z_3$ represents the same as the group denoted above in Formula (Y-III), $R_{24}$ represents an alkyl group, $R_{25}$ represents an alkyl group or an aromatic group, Ar represents a phenyl group having at least one substituent in an ortho position, $X_3$ represents an organic residue necessary to form a nitrogen-containing single or condensed heterocyclic ring together with —C($R_{26}$)($R_{27}$) and —N=, $X_4$ represents an organic residue necessary to form a nitrogen-containing single or condensed heterocyclic ring together with —C($R_{28}$)=C($R_{29}$) and —N=, and $R_{26}$, $R_{27}$, $R_{28}$ and $R_{29}$ independently represent a hydrogen atom or a substituent.

In Formula (Y-IIIa), (Y-IIIb) or (Y-IIIc), $R_{24}$ through $R_{29}$, $X_3$, $X_4$, and Ar independently represents the same as the corresponding group denoted above in Formula (Y-III). The substituent of $R_{26}$, $R_{27}$, $R_{28}$ and $R_{29}$ includes the same as the substituent that the nitrogen-containing heterocyclic group, in which $R_{21}$ and $R_{22}$ described above combine with each other, may have.

Of Formulas (Y-IIIa), (Y-IIIb) and (Y-IIIc), especially preferable is a coupler represented by Formula (Y-IIIb) or (Y-IIIc).

The coupler represented by Formula (Y-III) may be a dimer or a polymeride (for example, telomer or polymer) in which two or more of the coupler combine with each other through a divalent or polyvalent linkage in the group represented by $R_{21}$, $R_{22}$, $R_{23}$ or $Z_3$.

The coupler represented by Formula (Y-III) is preferably a non-diffusible coupler. The non-diffusible coupler herein referred to means a coupler having a high molecular weight group (a non-diffusible group) in its molecule to make the coupler immobile in the layer containing the coupler. As the non-diffusible group is used an alkyl group having 8–30, preferably 10–20 carbon atoms or an aryl group having a substituent of 4–20 carbon atoms. The non-diffusible coupler may have the non-diffusible group in any position in the coupler molecule and may have plural non-diffusible groups.

The yellow coupler represented by Formula (Y-III) can be easily synthesized from starting materials commercially available according to a conventional method disclosed in Japanese Patent O.P.I. Publication Nos. 4-174428/1992, 4-184434/1992, and 5-11416/1993.

The example of the yellow coupler represented by Formula (Y-III) will be shown below, but is not limited thereto.

III-1

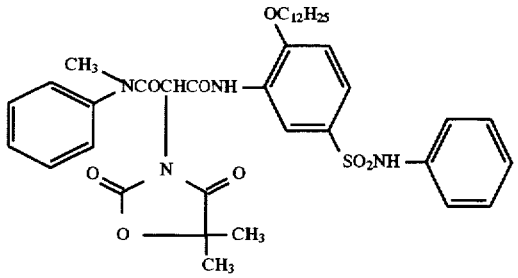

III-2

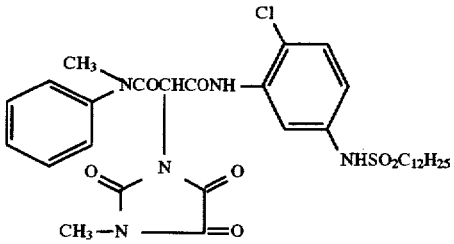

III-3

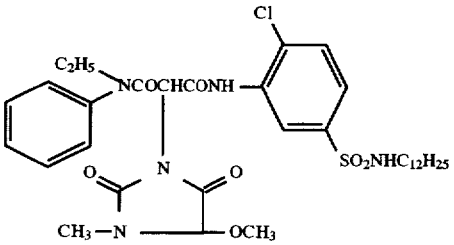

-continued
III-4
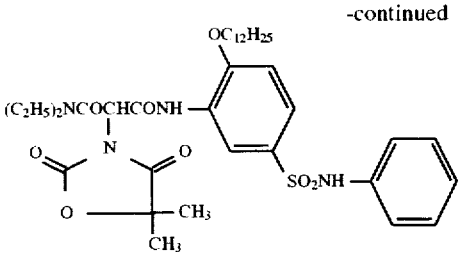
III-5
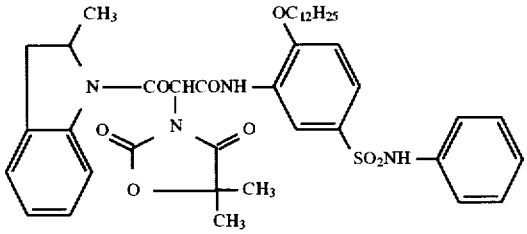
III-6
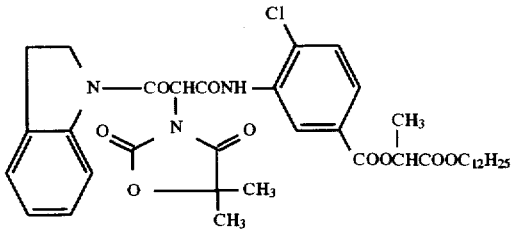
III-7
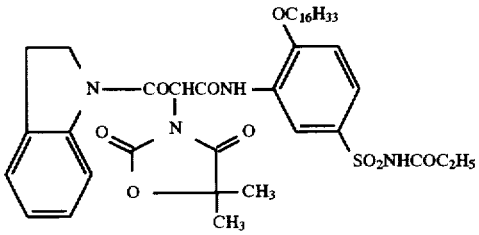
III-8
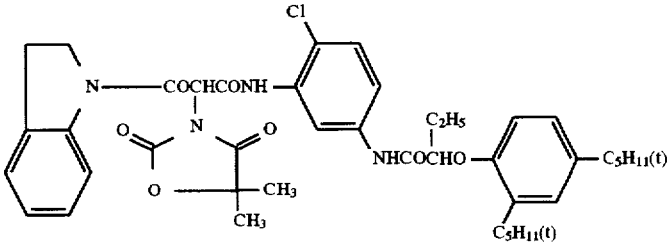
III-9
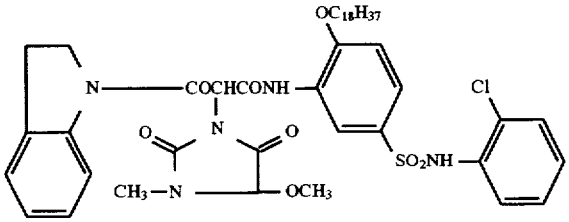
III-10
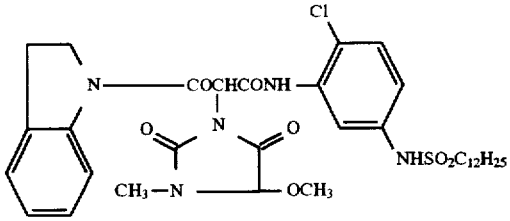

-continued
III-11
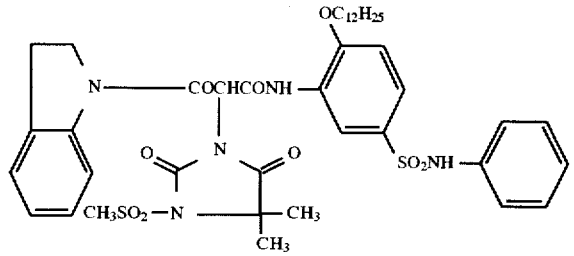
III-12
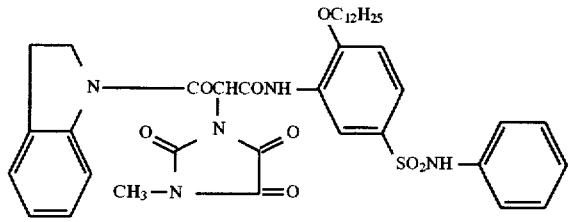
III-13
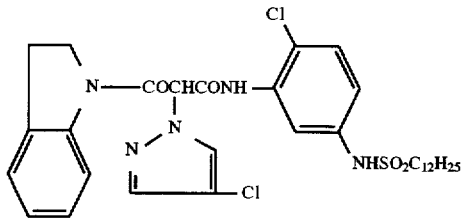
III-14
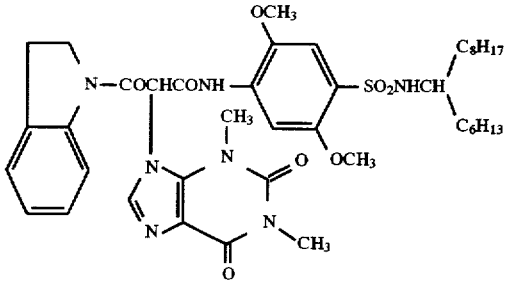
III-15
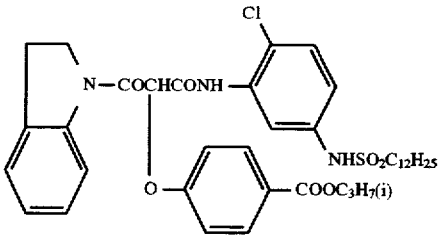
III-16
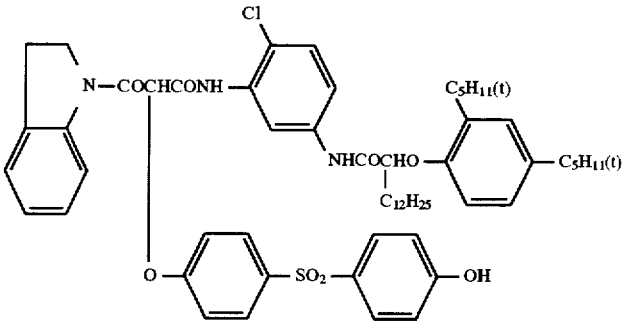
The yellow coupler used in the invention can be used in an amount of 1.0 to $1.0\times10^{-3}$ preferably $5.0\times10^{-1}$ to $5.0\times10^{-2}$, and more preferably $4.0\times10^{-1}$ to $2.0\times10^{-2}$ mol per mol of silver halide.

The magenta coupler used in the invention is a magenta coupler represented by the following Formula [M-I] or [M-II]:

Formula [M-I]

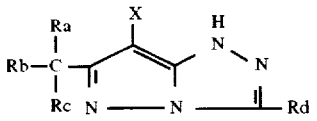

Formula [M-II]

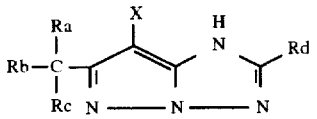

wherein $R_a$, $R_b$, $R_c$ and $R_d$ independently represent a hydrogen atom or a substitent, provided that two or more of $R_a$, $R_b$, $R_c$ and $R_d$ are not simultaneously hydrogen atoms or two or more of $R_a$, $R_b$ and $R_c$ combine with each other to form a ring; and X represents a hydrogen atom or a group capable of being released upon reaction with an oxidation product of a color developing agent.

The magenta coupler represented by Formula [M-1] or [M-II] will be explained below.

In Formula [M-1] or [M-II], $R_a$, $R_b$, $R_c$ and $R_d$ independently represent a hydrogen atom or a substituent, provided that two or more of $R_a$, $R_b$, $R_c$ and $R_d$ are not simultaneously hydrogen atoms. Two or more of $R_a$, $R_b$ and $R_c$ may combine with each other to form a ring. The substituent represented by $R_a$, $R_b$ and $R_c$ is not specifically limited but the typical group includes alkyl, aryl, cycloalkyl, heterocylic, halogen, hydroxy, alkoxy, anilino, acylamino and sulfonamido, and represents preferably alkyl. The substituent represented by $R_d$ is not specifically limited but the typical group includes alkyl, aryl, cycloalkyl, heterocylic, halogen, anilino, acylamino, alkoxy, aryloxy, heterocylic oxy, alkylthio, arylthio, sulfonyl, ureido, carbamoyl and sulfamoyl.

X represents a hydrogen atom or a group capable of being released upon reaction with an oxidation product of a color developing agent, and the group includes a halogen atom, an alkoxy group, an aryloxy group, an acyloxy group, an sulfonyloxy group, an alkylthio group or an arylthio group, represents preferably a halogen atom and more preferably a chlorine atom.

The magenta coupler represented by Formula [M-1] is more preferable of the above two.

The examples of the magenta coupler represented by Formula [M-I] or [M-II] will be shown below, but are not limited thereto.

MCP-1

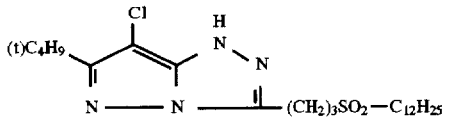

MCP-2

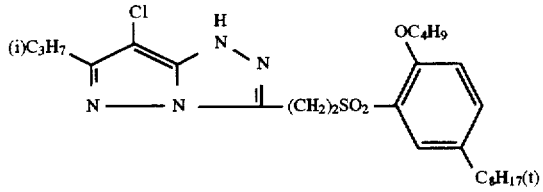

MCP-3

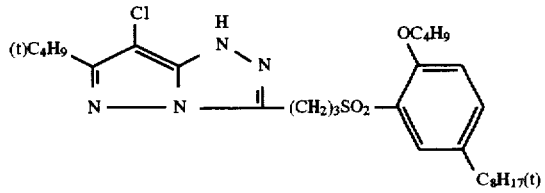

MCP-4

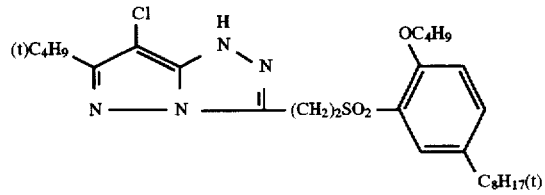

MCP-5

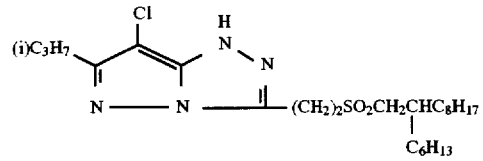

-continued
MCP-6
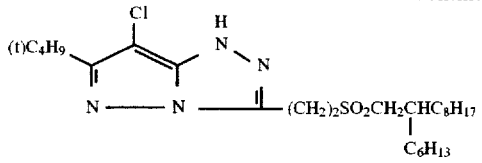
MCP-7
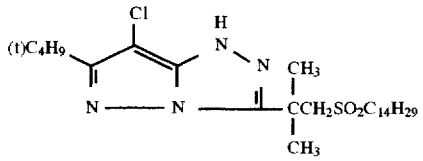
MCP-8
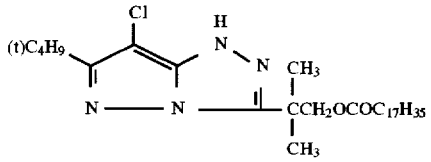
MCP-9
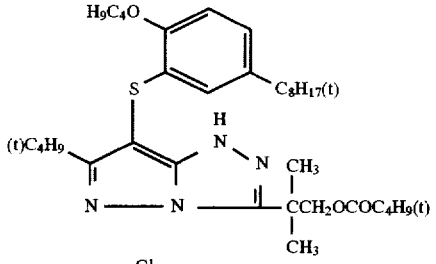
MCP-10
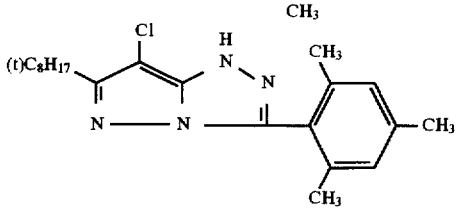
MCP-11
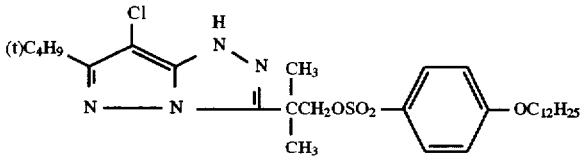
MCP-12
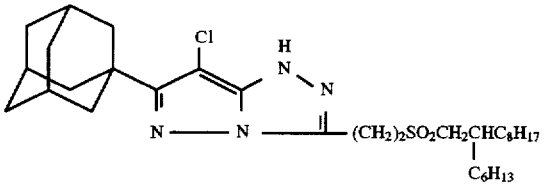
MCP-13
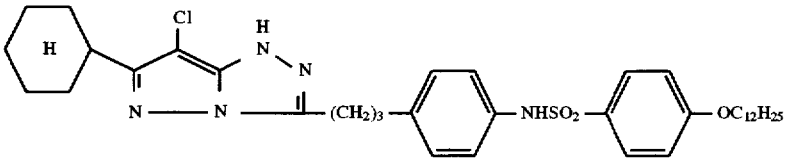
MCP-14
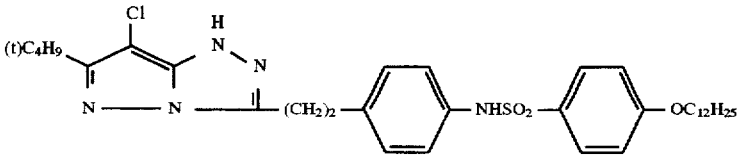

-continued
MCP-15
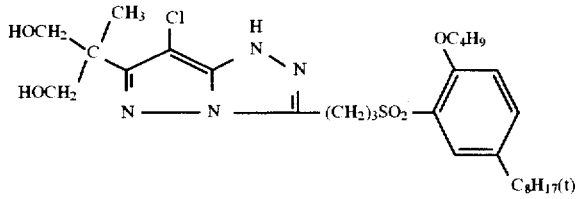
MCP-16
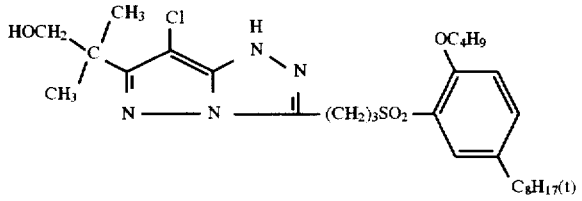
MCP-17
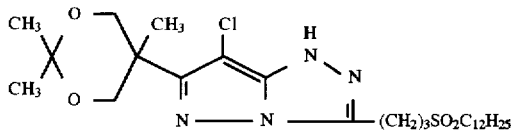
MCP-18
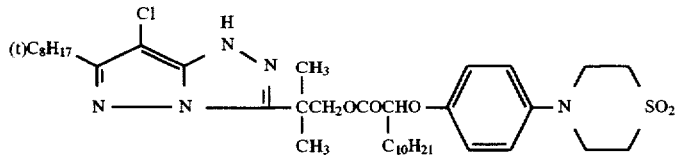
MCP-19
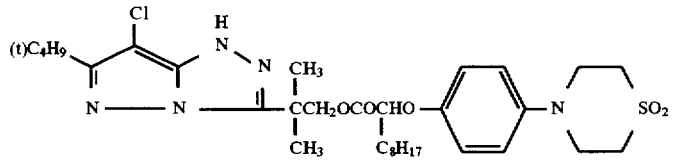
MCP-20
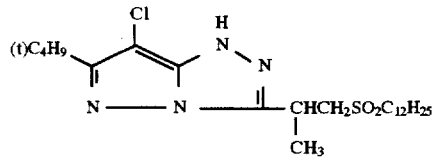
MCP-21
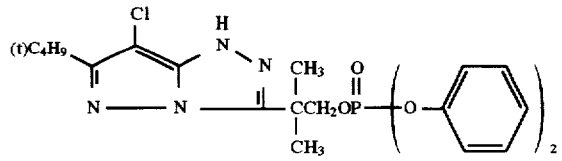
MCP-22
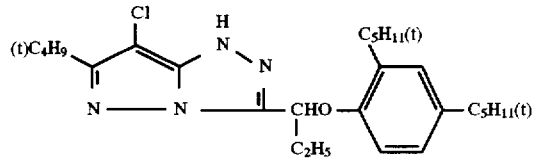
MCP-23
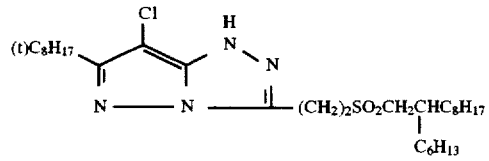

-continued
MCP-24
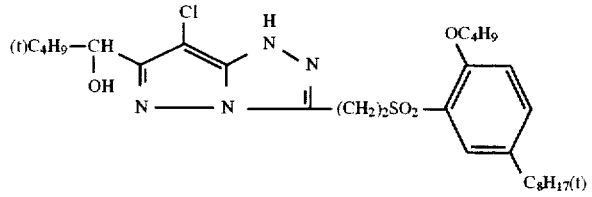
MCP-25
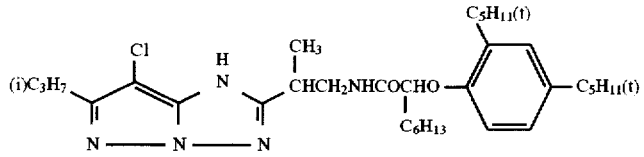
MCP-26
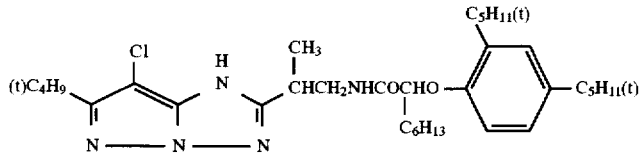
MCP-27
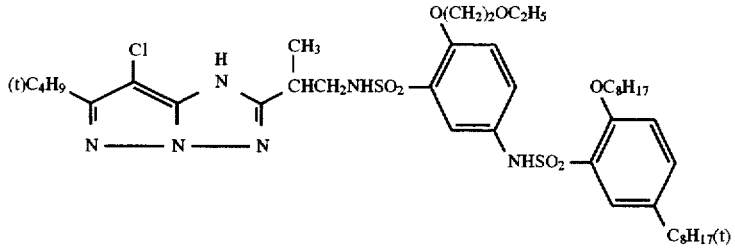
MCP-28
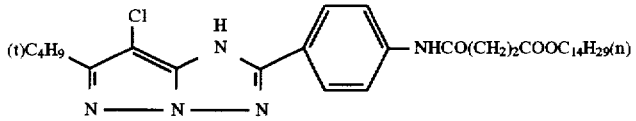
MCP-29
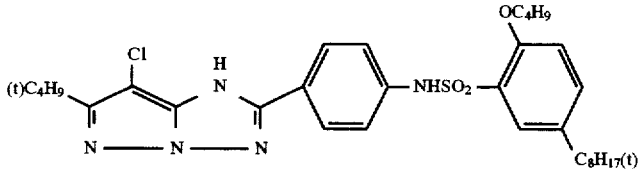
MCP-30
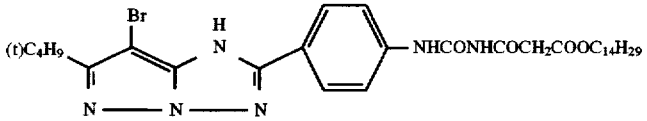
MCP-31
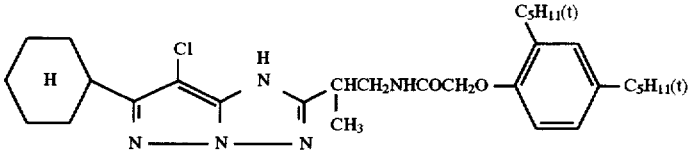
MCP-32
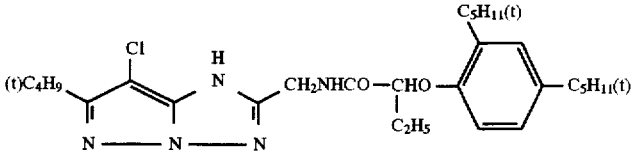

The magenta coupler used in the invention is used in an amount of preferably $1\times10^{-3}$ to 5 mol per mol of silver halide, and more preferably $1\times10^{-2}$ to 1 mol per mol of silver halide.

The silver halide composition used in the invention is preferably silver bromochloride containing 95 mol % of silver chloride and containing substantially no silver iodide. The silver bromochloride more preferably contains 97 mol % of silver chloride, and still more preferably contain 98 to 99.9 mol % of silver chloride.

In order to obtain the silver halide emulsion in the invention, a silver halide emulsion comprising a high concentration of silver bromide is preferably used.

The above silver halide emulsion may be a silver halide emulsion layer comprising epitaxial depositions, so-called a core/shell emulsion, or a silver halide emulsion comprising in admixture silver halide grains different in halide composition. The silver halide grain composition may be varied continuously or discontinuously. The portions in which silver bromide comprises in a high concentration are especially preferable corners of the surface of silver halide crystals.

The silver halide grains advantageously contain a heavy metal ion. The heavy metal ion includes an ion of the eighth to tenth group metal in the periodic table such as iron, iridium, platinum, palladium, nickel, rhodium, osmium, ruthenium or cobalt, the twelfth group metal in the periodic table such as cadmium, zinc or mercury, lead, rhenium, molybdenum, tungsten, gallium or chromium. Of these, an iridium, platinum, ruthenium, gallium and osmium ion are preferable. These metal ions are preferably added to a silver halide emulsion in the form of their salts or complexes.

When the heavy metal ions form complexes, a ligand or ligand ion includes a cyanide ion, a thiocyanate ion, a cyanate ion, a chloride ion, a bromide ion, an iodide ion, a nitrate ion, carbonyl and ammonia. Of these, a cyanide ion, a thiocyanate ion, an isothiocyanate ion, a chloride ion and a bromide ion are preferable.

In order to incorporate the heavy metal ion into a silver halide emulsion, the heavy metal compound may be added before or during silver halide grain formation or during physical ripening after the silver halide grain formation. In order to obtain a silver halide emulsion meeting the above described, a solution containing the heavy metal compound and a halide in admixture may be added continuously during silver halide grain formation.

The addition amount of the heavy metal compound is preferably $1\times10^{-9}$ mol or more, more preferably $1\times10^{-2}$ mol or less, and especially preferably $1\times10^{-8}$ to $1\times10^{-5}$ mol based on 1 mol of silver halide.

The silver halide grains may be of any shape. The preferable example is a cube having (100) face as a crystal surface. The silver halide grains having octahedron, tetradecahedron or dodecahedron prepared according to the descriptions described in U.S. Pat. Nos. 4,183,756 and 4,225,666, Japanese Patent O.P.I. Publication Nos. 55-26589/1980 and Japanese Patent No. 55-42737/1980 may be used. Further, the silver halide grains having twin plains may be used.

The silver halide grains used in the invention is preferably of single shape, but two or more kinds of monodispersed silver halide emulsions are preferably contained in the same silver halide emulsion layer.

The grain size of the silver halide emulsion is not specifically limited, but is preferably 0.1 to 1.2 μm, and more preferably 0.2 to 1.0.

This grain size can be measured using a projected area of the grains or an approximate diameter. When the grains are uniform, the grain size distribution can be considerably correctly expressed in terms of a diameter or a projected area.

The silver halide grains are monodispersed grains having a grain size distribution of a variation coefficient of preferably 0.05 to 0.22, and more preferably 0.05 to 0.15. Especially preferably, two or more kinds of the monodispersed grains having a grain size distribution of a variation coefficient of 0.15 to 0.22 are incorporated in the same silver halide emulsion layer. Herein, a variation coefficient shows the broadness of the grain size distribution, and is defined as the following expression:

$$\text{Variation coefficient}=S/R,$$

wherein S represent a standard deviation of grain size distribution; and R represent an average grain size.

Herein, when the grains are spherical, grain size represents a diameter, and when the grains are cubic or not spherical, grain size represents a diameter of a circle corresponding to a projected area of the grains.

As an apparatus and a method for preparing silver halide emulsions, various conventional ones known in the field can be used.

The silver halide emulsions of the present invention may be prepared through any of those including an acid process, a neutral process and an ammonia process. Aforesaid grains may be grown directly, or may be grown after producing seed grains. A method for producing seed grains and a method for growing them may be the same or different.

In addition, as a method to cause soluble silver salt and a soluble halogenated salt to react, any of a normal precipitation method, a reverse precipitation method, a double-jet method and combination thereof are allowed. Of them, those obtained through a double-jet method is desirable. In addition, as one type of a double-jet method, pAg-controlled double jet method described in Japanese Patent O.P.I. Publication No. 48521/1979 can also be used.

In addition, an apparatus disclosed in Japanese Patent O.P.I. Publication Nos. 92523/1982 and 92524/1982 wherein water-soluble silver salt and water-soluble halogenated compound salt aqueous solution is fed from an addition device placed in an initial solution for reaction, an apparatus disclosed in German Patent No. 2921164 wherein the concentration of water-soluble silver salt and water-soluble halogenated compound salt aqueous solution is continuously changed for adding, or an apparatus disclosed in Japanese Patent Publication No. 501776/1981 wherein grains are formed while the distance between each silver halide grain is kept constant by taking an initial solution outside of a reactor and concentrating it by the use of a ultra filtration method may be used.

In addition, if necessary, silver halide solvents such as thioether may be used. In addition, compounds having a mercapto group and compounds such as nitrogen-containing heterocycles or sensitizing dyes may be used by adding during formation of silver halide grains or after completion of forming grains.

The silver halide emulsion may be sensitized by the use of sensitizing methods using gold compounds and sensitizing methods using chalcogen sensitizers in combination.

As chalcogen sensitizers applicable, sulfur sensitizers, selenium sensitizers and tellurium sensitizers can be used. Among them, sulfur sensitizers are desirable. As sulfur sensitizers, thiosulfate, allylthiocarbamidothiourea, allylisothiacyanate, cystine, p-toluenethiosulfonate salt, rhodanine and an inorganic sulfur are cited.

The added amount of sulfur sensitizers is different depending upon the kind of silver halide emulsion and intended effects, preferably $5\times10^{-10}$ to $5\times10^{-5}$ mol per mol of silver halide, and more preferably $5\times10^{-8}$ to $3\times10^{-5}$ mol per mol of silver halide.

The gold sensitizers applicable can be added in the form of gold chloride, silver chloride, gold sulfide, gold thiosulfate and various gold complex. As compounds to be used therein, dimethylrhodanine, thiocyanate, mercaptotetrazole and mercaptotriazole are cited. The added amount of gold compounds is different depending upon the kind of silver halide emulsion, kind of compounds used and ripening conditions, preferably $1\times10^{-4}$ to $1\times10^{-8}$ mol per mol of silver halide, and more preferably $1\times10^{-5}$ to $1\times10^{-8}$ mol per mol of silver halide.

As chemical sensitizing of the silver halide emulsion reduction sensitizing may be carried out.

In the silver halide emulsion, conventional anti-foggants and stabilizers can be used for preventing fog which occurs during preparation step of a silver halide photographic light-sensitive material, for reducing fluctuation in properties during storage and preventing fog which occurs when being developed. As an example of compounds used for such purposes, compounds represented by formula (II) described in the lower column on page 7 of Japanese Patent O.P.I. Publication No. 146036/1990 are cited. Practical examples thereof are compounds (IIa-1) through (IIa-8) and (IIb-1) through (IIb-7); 1-(3-methoxyphenyl)-5-mercaptotetrazole and 1-(4-ethoxyphenyl)-5-mercaptotetrazole are cited.

These compounds are added, depending upon their purposes, in a preparation step, in a chemical sensitization step, at the end of chemical sensitization step and in a preparation step for a coating solution. When chemical sensitization is carried out in the presence of these compounds, the addition amount of these compounds are preferably $1\times10^{-5}$ to $5\times10^{-4}$ per 1 mol of silver halide. When these compounds are added after completion of chemical sensitization, the addition amount of these compounds are preferably $1\times10^{-6}$ to $1\times10^{-2}$, and more preferably $1\times10^{-5}$ to $5\times10^{-3}$ per 1 mol of silver halide. When these compounds are added to the silver halide emulsion during preparation of the coating solution, the addition amount of these compounds are preferably $1\times10^{-6}$ to $1\times10^{-1}$, and more preferably $1\times10^{-5}$ to $1\times10^{-2}$ per 1 mol of silver halide. When these compounds are added to coating layers other than silver halide emulsion layers, the content in the coating layer of these compounds are preferably $1\times10^{-9}$ to $1\times10^{-3}$ per $m^2$ of the coating layer.

To the silver halide photographic light-sensitive materials of the present invention, dyes having absorption ability for various wavelength can be used for preventing irradiation and halation. The conventional dyes can be used, and, dyes AI-1 to AI-11 described in Japanese Patent O.P.I. Publication No. 3-251840/1991, page 308 or dyes described in Japanese Patent O.P.I. Publication No. 6-3770/1994 are preferably used, as dyes having an absorption in the visible light wavelength region. The dyes represented by the general formula (I), (II) or (III) described in Japanese Patent O.P.I. Publication No. 1-280750/1989, page 2, lower left side are preferably used as infrared absorption dyes which have preferable spectral characteristic, in view of no adverse affect on photographic properties of photographic emulsions or staining due to remaining color. The preferable examples includes exemplified compounds (1) through (45) described in Japanese Patent O.P.I. Publication No. 1-280750/1989, page 3, lower left side through page 5, lower left side.

The addition amount of these dyes is preferably an amount necessary to give a spectral reflective density at 680 nm of preferably 0.7 to 3.0, and more preferably 0.8 to 3.0 in non-processed light sensitive material, in view of sharpness improvement.

The light sensitive material preferably contains a brightening agent in view of white background improvement. The brightening agent preferably includes the compound represented by formula II described in Japanese Patent O.P.I. Publication No. 2-2326520/1990.

The light sensitive material of the invention includes a silver halide emulsion layer containing a yellow coupler, a magenta coupler and a cyan coupler in combination, which is sensitized in the specific range of 400 to 900 nm. The silver halide emulsion layer comprises one or more sensitizing dyes.

The conventional spectral sensitizing dye can be used in the silver halide emulsion in the invention. As a blue sensitive sensitizing dye, dyes BS-1 through BS-8 described in Japanese Patent O.P.I. Publication No. 3-251840/1991, page 28 are preferably used singly or in combination. As a green sensitive sensitizing dye, dyes GS-1 through GS-5 described in the same Japanese Patent O.P.I. Publication, page 28 are preferably used, and as a red sensitive sensitizing dye, dyes RS-1 through RS-8 described in the same Japanese Patent O.P.I. Publication, page 29 are preferably used. When imagewise exposure is carried out using an infrared light such as a semi-conductor laser, an infrared sensitizing dye needs to be used. In such case, as an infrared sensitive sensitizing dye, dyes IRS-1 through IRS-11 described in Japanese Patent O.P.I. Publication No. 4-285950/1992, pages 6 to 8 are preferably used. In addition to these infrared, red, green and blue sensitizing dyes, super sensitizers SS-1 through SS-9 described in Japanese Patent O.P.I. Publication No. 4-285950/1992, pages 8 to 9 or compounds S-1 through S-17 described in Japanese Patent O.P.I. Publication No. 5-66515/1993, pages 15 to 17 are preferably used in combination.

These sensitizing dyes are added in any step from silver halide grain formation to completion of chemical sensitization.

The sensitizing dyes are added to the silver halide emulsion in the form of solution, in which the dyes are dissolved in water or a water-miscible organic solvent such as methanol, ethanol, fluorinated alcohol, acetone or dimethylformamide or their solid dispersion.

When a coupler or another organic compound is added to the silver halide photographic light sensitive material in the invention using an oil in water type emulsifying method, the coupler is usually dissolved in a water-insoluble, high boiling point organic solvent having a boiling point of 150° C. or more, a low boiling point and/or water soluble organic solvent being optionally added, the solution is added to a hydrophilic binder solution such as a gelatin solution, and then emulsified using a surfactant. The emulsifying means includes a stirrer, a homogenizer, a colloid mill, a flow-jet mixer and a ultrasonic emulsifier. The process removing a low boiling point organic solvent may be added during or after the emulsification. As a high boiling point organic solvent used for dissolving and emulsifying a coupler, phthalates such as dioctyl phthalate, diisodecyl phthalate and dibutyl phthalate or phosphates such as tricresyl phosphate and trioctyl phosphate are preferable. The dielectric constant of the high boiling point solvent is preferably 3.5 to 7.0. Two or more high boiling point solvents can be used in combination.

Beside the method employing a high boiling point organic solvent, a method is used in which a water insoluble, organic solvent soluble polymer are dissolved in a high boiling point organic solvent and optionally in a low boiling point and/or water soluble organic solvent and emulsified in a hydrophilic binder solution such as a gelatin solution, using a surfactant. The water insoluble and organic solvent soluble polymer includes poly(N-t-butylacrylamide).

The preferable surfactant used in dispersing photographic additives or adjusting surface tension includes compounds which have a hydrophobic group with 8 to 30 carbon atoms and a sulfonic acid group or its salt group in a molecule. The examples include compounds A-1 to A-11 described in Japanese Patent O.P.I. Publication No. 62-26854/1987. The surfactant having a fluorinated alkyl group is preferably used. The dispersion solution of the compounds is usually added to a coating solution containing a silver halide emulsion. The time between their dispersion and their addition to the coating solution or the time between their addition and the coating is preferably shorter, each being preferably 10 hours or less, more preferably 3 hours or less and still more preferably 20 minutes or less.

The anti-fading additive is preferably added to each coupler layer in the invention in order to prevent discoloration of a formed dye image due to light, heat or humidity. The especially preferable compounds include phenylether compounds represented by formulas I to II described in Japanese Patent O.P.I. Publication No. 2-66541/1990, 3 page, phenol compounds A-1 to A-11 represented by formula IIIB described in Japanese Patent O.P.I. Publication No. 3-174150/1987, amine compounds represented by formula A described in Japanese Patent O.P.I. Publication No. 64-90445/1989, and metal complexes represented by formula XII, XIII, XIV or XV described in Japanese Patent O.P.I. Publication No. 62-182741/1987, which are preferable especially for a magenta dye. The compounds represented by formula I' described in Japanese Patent O.P.I. Publication No. 1-196049/1989 or compounds represented by formula II described in Japanese Patent O.P.I. Publication No. 5-11417/1993 are preferable for a yellow or cyan dye.

For the purpose of shifting an absorption wavelength of a color dye compound (d-11) described on pages 33 and compound (A'-1) described on pages 35 of Japanese Patent O.P.I. Publication No. 4-114152/1992 can be used. Besides the compounds, a fluorescent dye releasing compound disclosed in U.S. Pat. No. 4,774,187 are used.

In the silver halide light sensitive material in the invention, the compound capable of reacting with an oxidation product of a color developing agent is preferably added to the layers between the two silver halide emulsion layers to prevent color mixture or to the silver halide emulsion layers to restrain fog. The compounds include preferably hydroquinone derivatives, more preferably dialkylhydroquinone such as 2,5-di-t-octylhydroquinone. The especially preferable compounds includes a compound represented by formula II described in Japanese Patent O.P.I. Publication No. 4-133056/1992, and compounds II-1 through II-14 on pages 13 and 14 and compound 1 described on page 17, of the same Japanese Patent.

The UV absorber is preferably added to light sensitive material in the invention to restrain static fog or to improve light fastness of a formed dye image. The preferable UV absorber includes benzotriazoles, and more preferably a compound represented by formula III-3 described in Japanese Patent O.P.I. Publication No. 1-250944/1989, a compound represented by formula III described in Japanese Patent O.P.I. Publication No. 64-66646/1989, UV-1L through UV-27L described in Japanese Patent O.P.I. Publication No. 63-187240/1988, a compound represented by formula I described in Japanese Patent O.P.I. Publication No. 4-1633/1992, and a compound represented by formula (I) or (II) described in Japanese Patent O.P.I. Publication No. 5-165144/1993.

For the silver halide photographic light-sensitive materials, it is advantageous to use gelatin as a binder. In addition, other gelatins, gelatin derivatives, graft polymers between gelatin and other polymers, proteins other than gelatin, sugar derivatives, cellulose derivatives and hydrophilic colloid such as synthetic hydrophilic polymers including homopolymers or copolymers can also be used if necessary.

The hardeners for a binder may be used. As hardeners, vinylsulfone type hardeners and chlorotriazine type hardeners are preferably used singly or in combination. The compounds described in Japanese Patent O.P.I. Publication Nos. 61-249054/1986 and 61-245153/1986 are preferably used. The antiseptic agent or anti-fungal described in Japanese Patent O.P.I. Publication No. 3-157646/1991 are preferably added to the colloid layer in order to prevent breed of bacilli or fungi which adversely affects photographic properties or image storage stability. The lubricant or matting agent described in Japanese Patent O.P.I. Publication Nos. 6-118543/1994 and 2-73250/1990 is preferably added to a protective layer in order to improve surface property of the non-processed or processed light sensitive material.

After the surface of the support is provided with corona discharge, UV ray irradiation and firing treatment if necessary, a light-sensitive materials may be coated directly or through subbing layers (one or two or more subbing layer in order to improve adhesiveness, anti-static property stability in sizing, anti-abrasion property, stiffness, anti-halation property, abrasion property and/or other properties of the surface of the support.)

When a light-sensitive materials using silver halide emulsions is coated, a thickener may be used. As coating methods, an extrusion coating method and a curtain coating method is especially advantageous because they can coat 2 or more layers concurrently.

An image forming method employing the color light sensitive material of the invention includes a method comprising printing on a photographic paper an image formed on a negative, a method comprising converting an image to digital information, displaying the image from the information on a CRT (cathode ray tube), and then printing the displayed image on a photographic paper, and a method comprising printing an image on a photographic paper by scanning a laser light which strength is varied based on digital information.

The invention is applied to preferably a light sensitive material containing no color developing agent, and more preferably a light sensitive material capable of forming an image for direct appreciation. The example includes color paper, color reversal paper, a light sensitive material capable of forming a positive image, a light sensitive material for display and a light sensitive material for color proof. The invention is applied to especially preferably a light sensitive material having a reflective support.

The aromatic primary amine color developing agents used in the present invention include a conventional compound. The examples will be shown below.

CD-1): N,N-Diethyl-p-phenylenediamine

CD-2): 2-Amino-5-diethylaminotoluene

CD-3): 2-Amino-5-(N-ethyl-N-laurylamino)toluene

CD-4): 4-(N-ethyl-N-β-hydroxyethyl)aminoaniline

CD-5): 2-Methyl-4-(N-ethyl-N-β-hydroxyethyl) aminoaniline

CD-6): 4-amino-3-methyl-N-ethyl-N-(β-methanesulfonamidoethyl)aniline

CD-7): 4-amino-3-(β-methanesulfonamidoethyl)-N,N-diethylaniline

CD-8): N,N-Dimethyl-p-phenylenediamine

CD-9): 4-Amino-3-methyl-N-ethyl-N-methoxyethylaniline

CD-10): 4-Amino-3-methyl-N-ethyl-N-(β-hydroxyethyl) aniline

CD-11): 4-Amino-3-methyl-N-ethyl-N-(γ-hydroxypropyl) aniline

In the invention the pH of color developer may be any, but preferably within the range of 9.5 to 13.0, and more preferably within the range of 9.8 to 12.0 in view of rapid processing.

The color developing temperature is preferably 35° to 70° C. The temperature is preferably higher in view of shorter processing time, but is preferably not so high in view of processing stability. The developing is carried out at preferably 37° to 60° C.

The color developing is carried out ordinarily in about 3.5 minutes. The color developing is carried out preferably in not more than 40 seconds, and more preferably in not more than 25 seconds, in view of rapid processing.

The color developer may contain conventional developing components in addition to the above color developer. The developing components include an alkaline agent having a buffer effect, a chloride ion or a developing inhibitor such as benzotriazole, a preservative and a chelating agent.

The light sensitive material is color developed, bleached and then fixed. The bleaching may be carried out at the same time as fixing. After the fixing, washing is usually carried out. Stabilizing may be carried out instead of washing. The developing apparatus using development of light sensitive material may be a roller transport type which transports the light sensitive material sandwiched between the rollers or an endless belt type which transports the light sensitive material fixed on the belt. As a processing method is used a method of feeding light sensitive material and a processing solution into a slit-shaped processing tank, a method of processing light sensitive material jetting a processing solution, a web method of contacting light sensitive material with a carrier impregnated with a processing solution or a method of processing light sensitive material with a viscous processing solution. A large amount of light sensitive materials are usually running processed using an automatic processor. The replenishing amount of replenisher is preferably small, and the replenishing is most preferably carried out using replenisher tablets in view of environmental property. The replenishing method is most preferably a method described in Journal of Technical Disclosure 94-16935.

EXAMPLE

The invention will be explained according to the following examples, but is not limited thereto.

The supports A through L were prepared according to the following procedures, including the inventive supports.

[Preparation of supports]

Polyethylene (density of 0.95 g/cc, melt index (MI) of 8.0 g/10 minutes) was extrusion coated on one side of white paper base (basis weight of 175 g/m$^2$, thickness of 180 μm) for photographic print to form a back laminate layer. Thus, a sheet substrate was prepared.

The following resin layer composition was coated on the surface of the substrate opposite the back laminate layer. Thus, supports A through L were prepared.

Support A:

Polyethylene (density of 0.92 g/cc, melt index (MI) of 5.0 g/10 minutes) of 90 weight % and 10 weight % of titanium oxide (anatase type) white pigment were kneaded and extrusion coated on the surface of the substrate opposite the back laminate layer to obtain a water proofing resin layer of 30 g/m$^2$.

Support B:

The composition containing the following electron beam hardenable organic compound and white pigment was prepared.

| | |
|---|---|
| Polyester acrylate | 25 weight % |
| Hexanediol diacrylate | 25 weight % |
| Trimethylolpropane triacrylate | 15 weight % |
| Titanium oxide (anatase type) | 40 weight % |

The above mixture was kneaded for 20 hours in a ball mill.

The above mixture was coated on the surface of the substrate to obtain a coating amount after hardening of 30 g/m$^2$. The coated was irradiated with an electron beam from the back laminate layer side at an accelerating voltage of 200 KV and at an absorbed dose of 2 Mrad to obtain a hardened resin layer.

Support C:

Polyethylene (density of 0.95 g/cc, melt index (MI) of 8.0 g/10 minutes) of 80 weight % and 20 weight % of titanium oxide (anatase type) white pigment were kneaded and extrusion coated on the surface of the substrate to obtain a water proofing resin layer of 10 g/m$^2$ for a resin layer (hereinafter referred to as an inner resin layer) adjacent to the paper base.

Next, polyethylene (density of 0.92 g/cc, melt index (MI) of 5.0 g/10 minutes) of 90 weight % and 10 weight % of titanium oxide (anatase type) white pigment were kneaded and extrusion coated on the inner resin layer to obtain a water proofing resin layer of 20 g/m$^2$ for a resin layer (hereinafter referred to as an outer resin layer) closest to the silver halide emulsion layer.

Support D:

Polyethylene terephthalate (intrinsic viscosity of 0.72 cc/g) of 75 weight % and 25 weight % of titanium oxide (anatase type) white pigment were kneaded and extrusion coated at 300° C. on the surface of the substrate to obtain a water proofing resin layer of 15 g/m$^2$ for an inner resin layer.

Support D:

Next, polyethylene terephthalate (intrinsic viscosity of 0.72 cc/g) of 85 weight % and 15 weight % of titanium oxide (anatase type) white pigment were kneaded and extrusion coated at 300° C. on the inner resin layer to obtain a water proofing resin layer of 15 g/m$^2$ for an outer resin layer.

Support E:

The following modified polyester was prepared.

The ester exchange reaction was carried out according to a conventional method in a mixture of 100 weight % dimethyl terephthalate, 14 weight % dimethyl naphthalene-2,6-dicarboxylate and 80 weight % ethylene glycol. The resulting mixture was mixed with 0.05 weight % antimony trioxide and gradually heated and evacuated. Polymerization was carried out at 280° C. and 0.5 mmHg. Thus, modified polyester containing a terephthalic acid and naphthalene-2,6-dicarboxylic acid unit (90/10, mol ratio) was obtained. The intrinsic viscosity of the resulting modified polyester was 0.7 cc/g.

The modified polyester of 78 weight % and 22 weight % of titanium oxide (rutile type) white pigment were kneaded and extrusion coated at 300° C. on the surface of the substrate to obtain a water proofing resin layer of 20 g/m$^2$ for an inner resin layer.

Next, polyethylene (density of 0.92 g/cc, melt index (MI) of 5.0 g/10 minutes) of 85 weight % and 10 weight % of titanium oxide (anatase type) white pigment were kneaded and extrusion coated on the inner resin layer to obtain a water proofing resin layer of 10 g/m$^2$ for an outer resin layer.

Support F:

The composition containing the following electron beam hardenable organic compound and white pigment was prepared.

| | |
|---|---|
| Urethane acrylate oligomer | 25 weight % |
| Diethylene glycol diacrylate | 25 weight % |
| Titanium oxide (anatase type) | 50 weight % |

The above mixture was kneaded for 20 hours in a ball mill.

The above mixture was coated on the surface of the substrate to obtain a coating amount after hardening of 20 g/m$^2$. The coated was irradiated with an electron beam from the back laminate layer side at an accelerating voltage of 200 KV and at an absorbed dose of 2 Mrad to obtain a hardened resin layer for an inner resin layer.

Next, polyethylene (density of 0.92 g/cc, melt index (MI) of 5.0 g/10 minutes) of 99.5 weight % and 10 weight % of titanium oxide (anatase type) white pigment were kneaded and extrusion coated on the inner resin layer to obtain a water proofing resin layer of 10 g/m$^2$ for an outer resin layer.

Support G:

The composition containing the following electron beam hardenable organic compound and white pigment was prepared.

| | |
|---|---|
| Urethane acrylate oligomer | 25 weight % |
| Diethylene glycol diacrylate | 25 weight % |
| Titanium oxide (anatase type) | 50 weight % |

The above mixture was kneaded for 20 hours in a ball mill.

The above mixture was coated on the surface of the substrate to obtain a coating amount after hardening of 20 g/m$^2$. The coated was irradiated with an electron beam from the back laminate layer side at an accelerating voltage of 200 KV and at an absorbed dose of 2 Mrad to obtain a hardened resin layer for an inner resin layer.

Next, polyethylene terephthalate (intrinsic viscosity of 0.72 cc/g) of 80 weight % and 20 weight % of titanium oxide (anatase type) white pigment were kneaded and extrusion coated at 300° C. on the inner resin layer to obtain a water proofing resin layer of 10 g/m$^2$ for an outer resin layer.

Support H:

Polyethylene (density of 0.92 g/cc, melt index (MI) of 5.0 g/10 minutes) of 85 weight % and 15 weight % of titanium oxide (anatase type) white pigment were kneaded and extrusion coated on the surface of the substrate to obtain a water proofing resin layer of 20 g/m$^2$ for an inner resin layer.

The composition containing the following electron beam hardenable organic compound and white pigment was prepared.

| | |
|---|---|
| Polyester acrylate | 35 weight % |
| Hexanediol diacrylate | 35 weight % |
| Trimethylolpropane triacrylate | 15 weight % |
| Titanium oxide (anatase type) | 15 weight % |

The above mixture was kneaded for 20 hours in a ball mill.

The above mixture was coated on the surface of the substrate to obtain a coating amount after hardening of 10 g/m$^2$. The coated was irradiated with an electron beam from the back laminate layer side at an accelerating voltage of 200 KV and at an absorbed dose of 2 Mrad to obtain a hardened resin layer for an outer layer.

Support I:

Polyethylene terephthalate (intrinsic viscosity of 0.72 cc/g) of 70 weight % and 30 weight % of titanium oxide (anatase type) white pigment were kneaded and extrusion coated at 300° C. on the surface of the substrate to obtain a water proofing resin layer of 15 g/m$^2$.

The composition containing the following electron beam hardenable organic compound and white pigment was prepared.

| | |
|---|---|
| Polyester acrylate | 30 weight % |
| Hexanediol diacrylate | 30 weight % |
| Trimethylolpropane triacrylate | 25 weight % |
| Titanium oxide (anatase type) | 15 weight % |

The above mixture was kneaded for 20 hours in a ball mill.

The above mixture was coated on the inner layer to obtain a coating amount after hardening of 15 g/m$^2$. The coated was irradiated with an electron beam from the back laminate layer side at an accelerating voltage of 200 KV and at an absorbed dose of 2 Mrad to obtain a hardened resin layer for an outer layer.

Support J:

Polyethylene (density of 0.92 g/cc, melt index (MI) of 5.0 g/10 minutes) of 90 weight % and 10 weight % of titanium oxide (anatase type) white pigment were kneaded and extrusion coated on the surface of the substrate to obtain a water proofing resin layer of 10 g/m$^2$ for an inner resin layer.

The composition containing the following electron beam hardenable organic compound and white pigment was prepared.

| | |
|---|---|
| Urethane acrylate oligomer | 25 weight % |
| Acrylate monomer | 25 weight % |
| Titanium oxide (anatase type) | 50 weight % |

The above mixture was kneaded for 20 hours in a ball mill.

The above mixture was coated on the inner layer to obtain a coating amount after hardening of 15 g/m$^2$. The coated was irradiated with an electron beam from the back laminate layer side at an accelerating voltage of 200 KV and at an absorbed dose of 2 Mrad to obtain a hardened resin layer for an intermediate resin layer.

The composition containing the following electron beam hardenable organic compound and white pigment was prepared.

| | |
|---|---|
| Polyester acrylate | 35 weight % |
| Hexanediol diacrylate | 35 weight % |
| Trimethylolpropane triacrylate | 30 weight % |

The above mixture was coated on the intermediate resin layer to obtain a coating amount after hardening of 5 g/m$^2$. The coated was irradiated with an electron beam from the back laminate layer side at an accelerating voltage of 200 KV and at an absorbed dose of 2 Mrad to obtain a hardened resin layer for an outer layer.

Support K:

Polyethylene (density of 0.92 g/cc, melt index (MI) of 5.0 g/10 minutes) of 85 weight % and 10 weight % of titanium oxide (anatase type) white pigment were kneaded and extrusion coated on the surface of the substrate to obtain a water proofing resin layer of 10 g/m$^2$ for an inner resin layer.

The composition containing the following electron beam hardenable organic compound and white pigment was prepared.

| | |
|---|---|
| Polyester acrylate | 25 weight % |
| Hexanediol diacrylate | 25 weight % |
| Trimethylolpropane triacrylate | 10 weight % |
| Titanium oxide (anatase type) | 40 weight % |

The above mixture was kneaded for 20 hours in a ball mill.

The above mixture was kneaded for 20 hours in a ball mill.

The above mixture was coated on the inner layer to obtain a coating amount after hardening of 15 g/m$^2$. The coated was irradiated with an electron beam from the back laminate layer side at an accelerating voltage of 150 KV and at an absorbed dose of 2 Mrad to obtain a hardened resin layer for an intermediate resin layer.

The composition containing the following electron beam hardenable organic compound and white pigment was prepared.

| | |
|---|---|
| Dipentaerythritol hexacrylate | 80 weight % |
| Titanium oxide (anatase type) | 20 weight % |

The above mixture was kneaded for 20 hours in a ball mill.

The above mixture was coated on the intermediate layer to obtain a coating amount after hardening of 5 g/m$^2$. The coated was irradiated with an electron beam from the back laminate layer side at an accelerating voltage of 200 KV and at an absorbed dose of 2 Mrad to obtain a hardened resin layer for an outer resin layer.

The composition containing the following electron beam hardenable organic compound and white pigment was prepared.

| | |
|---|---|
| Polyester acrylate | 35 weight % |
| Hexanediol diacrylate | 35 weight % |
| Trimethylolpropane triacrylate | 30 weight % |

The above mixture was coated on the intermediate resin layer to obtain a coating amount after hardening of 5 g/m$^2$. The coated was irradiated with an electron beam from the back laminate layer side at an accelerating voltage of 200 KV and at an absorbed dose of 2 Mrad to obtain a hardened resin layer for an outer layer.

Support L:

Polyethylene terephthalate (intrinsic viscosity of 0.72 cc/g) of 75 weight % and 25 weight % of titanium oxide (anatase type) white pigment were kneaded and extrusion coated at 300° C. on the surface of the substrate to obtain a water proofing resin layer of 15 g/m$^2$.

The obverse surface of the above obtained supports A through L were corona discharged at an output electric current of 2 A and coated with a gelatin subbing layer to obtain a gelatin content of 40 mg/m$^2$.

Example 1

Each layer having a composition as shown below was coated on Support A to prepare a silver halide photographic light-sensitive material. The coating solution was prepared as follows:

First layer coating solution

To 23.4 g of yellow coupler (Y-1), 3.34 g of each of dye image stabilizers (ST-1), (ST-2) and (ST-5), 0.34 g of anti-stain agent (HQ-1), 5.0 g of image stabilizing agent A, 3.33 g of high boiling organic solvent (DBP) and 1.67 g of high boiling organic solvent (DNP), 60 cc of ethyl acetate were added and dissolved. The solution was emulsified and dispersed into 220 ml of a 10% aqueous gelatin solution containing 7 ml of 20% surfactant (SU-1) by the use of a supersonic homogenizer to prepare yellow coupler dispersion solution. This dispersion solution was mixed with the blue sensitive silver halide emulsion prepared according to the following to prepare the first layer coating solution.

The 2nd layer through the 7th layer were prepared to have a coating amount as shown in Tables 1 and 2 in the same manner as in the above-mentioned coating solution for the 1st layer.

In addition, as a hardener, (H-1) and (H-2) were added. As a coating aid, surfactants SU-2 and SU-3 were added to adjust a surface tension. Further, F-1 was added in a total amount of 0.04 g/m$^2$.

TABLE 1

| Layer | Structure | Added amount (g/m$^2$) |
|---|---|---|
| 7th layer (Protective layer) | Gelatin | 1.00 |
| | DIDP | 0.002 |
| | DBP | 0.002 |
| | Silicone dioxide | 0.003 |
| 6th layer (UV absorbing layer) | Gelatin | 0.40 |
| | UV absorber (UV-1) | 0.12 |
| | UV absorber (UV-2) | 0.04 |
| | UV absorber (UV-3) | 0.16 |
| | Anti-stain Agent (HQ-5) | 0.04 |
| | PVP | 0.03 |
| | Anti-irradiation agent (AI-1) | 0.01 |
| 5th layer (Red sensitive layer) | Gelatin | 1.30 |
| | Red sensitive silver bromochloride emulsion (Em-R) | 0.21 |
| | Cyan coupler (C-I-4) | 0.25 |
| | Cyan coupler (C-2') | 0.08 |
| | Dye image stabilizer (ST-1) | 0.10 |
| | Anti-stain agent (HQ-1) | 0.004 |
| | DBP | 0.10 |
| | DOP | 0.20 |
| 4th layer (UV absorbing layer) | Gelatin | 0.94 |
| | UV absorber (UV-1) | 0.28 |
| | UV absorber (UV-2) | 0.09 |
| | UV absorber (UV-3) | 0.38 |
| | Anti-stain agent (HQ-5) | 0.10 |
| | Anti-irradiation agent (AI-1) | 0.02 |
| 3rd layer (Green sensitive layer) | Gelatin | 1.30 |
| | Green sensitive silver halide emulsion (Em-G) | 0.14 |
| | Magenta coupler (M-1) | 0.20 |
| | Dye image stabilizer (ST-3) | 0.20 |
| | Dye image stabilizer (ST-4) | 0.17 |
| | DIDP | 0.13 |
| | DBP | 0.13 |
| | Anti-irradiation agent (AI-2) | 0.01 |

TABLE 2

| Layer | Structure | Added amount (g/m$^2$) |
|---|---|---|
| 2nd layer (Intermediate layer) | Gelatin | 1.20 |
| | Anti-stain agent (HQ-2) | 0.03 |
| | Anti-stain agent (HQ-3) | 0.03 |
| | Anti-stain agent (HQ-4) | 0.05 |
| | Anti-stain agent (HQ-5) | 0.23 |
| | DIDP | 0.04 |

TABLE 2-continued

| Layer | Structure | Added amount ($g/m^2$) |
|---|---|---|
| | DBP | 0.02 |
| | Fluorescent brightening agent (W-1) | 0.10 |
| | Anti-irradiation agent (AI-3) | 0.01 |
| 1st layer (Blue sensitive layer) | Gelatin | 1.20 |
| | Blue sensitive silver halide emulsion (Em-B) | 0.26 |
| | Yellow coupler (Y-1) | 0.70 |
| | Dye image stabilizer (ST-1) | 0.10 |
| | Dye image stabilizer (ST-2) | 0.10 |
| | Dye image stabilizer (ST-5) | 0.10 |
| | Image stabilizer A | 0.15 |
| | Anti-stain agent (HQ-1) | 0.01 |
| | DBP | 0.10 |
| | DNP | 0.05 |
| Support | Paper laminated with polyethylene (containing minute colorant) | |

The added amount of the silver halide emulsion is illustrated in terms of silver.

SU-1: Sodium tri-i-propylnaphthalene sulfonate

SU-2: Sodiumsulfo di(2-ethylhexyl)succinate

SU-3: Sodiumsulfo di(2,2,3,3,4,4,5,5-octafluoropentyl)-succinate

DBP: Dibutylphthalate

DNP: Dinonylphthalate

DOP: Dioctylphthalate

DIDP: Diisodecylphthalate

PVP: Polyvinylpyrrolidone

H-1: Tetrakis(vinylsulfonylmethyl)methane

H-2: Sodium 2,4-dichloro-6-hydroxy-s-triazine

HQ-1: 2,5-Di-t-octylhydroquinone

HQ-2: 2,5-Di-sec-dodecylhydroquinone

HQ-3: 2,5-Di-sec-tetradecylhydroquinone

HQ-4: 2-Sec-dodecyl-5-sec-tetradecylhydroquinone

HQ-5: 2,5-Di-(1,1-dimethyl-4-hexyloxycarbonyl) butylhydroquinone

Image stabilizer A: p-Octylphenol

Y-1

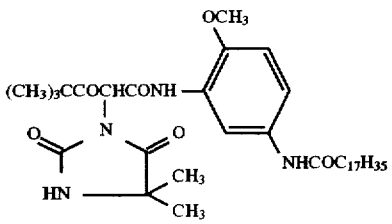

M-1

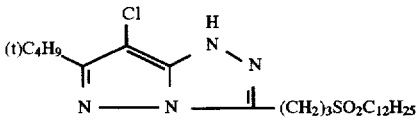

C-I-4

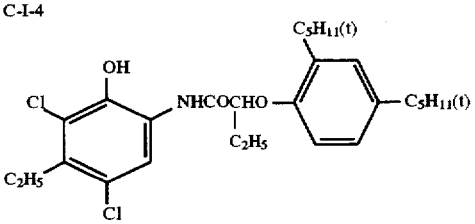

C'-2

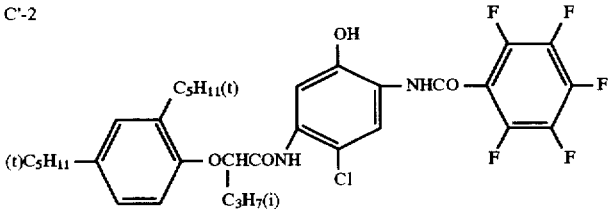

ST-1

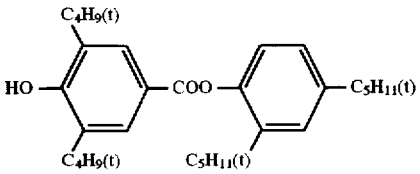

ST-2

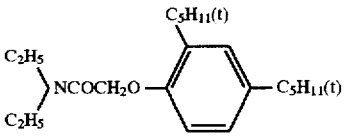

-continued
ST-3
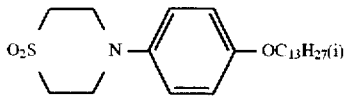
ST-4
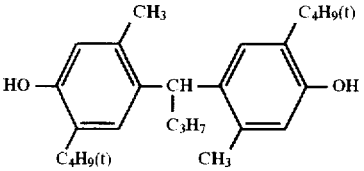
ST-5
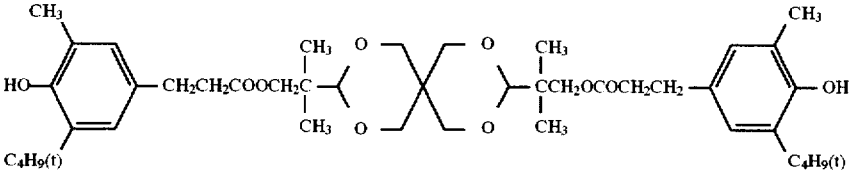
UV-1
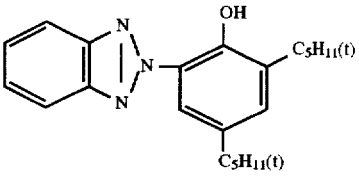
UV-2
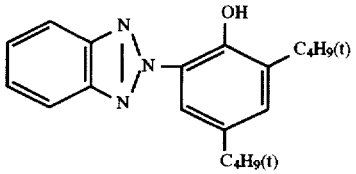
UV-3
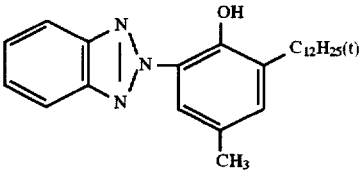
AI-1
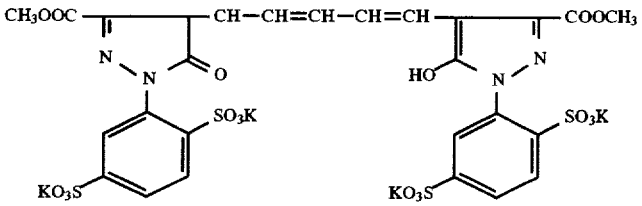
AI-2
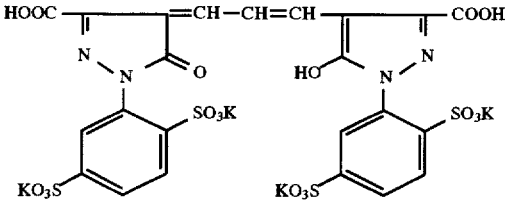
AI-3
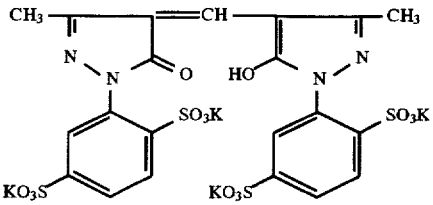
W-1
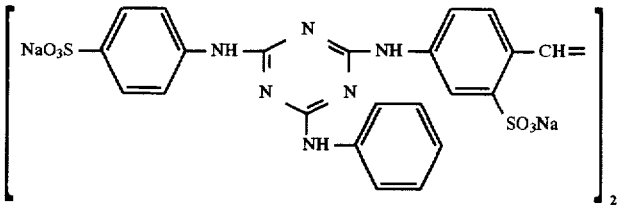

-continued

F-1

A mixture of

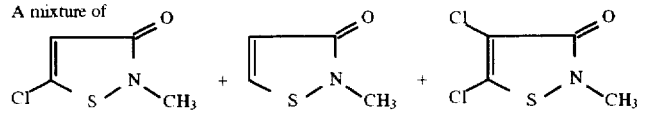

(50%) (46%) (4%)

mol ratio

SS-1

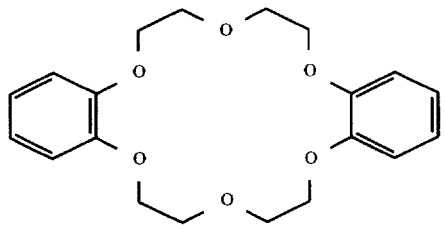

(Preparation of blue sensitive silver halide emulsion)

To 1 liter of a 2% aqueous gelatin solution kept at 40° C., the following Solutions A and B were concurrently added spending 30 minutes while pAg was controlled to 7.3 and pH was controlled to 3.0, and then, the following Solution C and D were concurrently added spending 180 minutes while pAg as controlled to 8.0 and pH was controlled to 5.5. The pAg was adjusted according to descriptions of Japanese Patent O.P.I. Publication No. 59-45437/1984, and the pAg was controlled with an aqueous sulfuric acid or sodium hydroxide solution.

| | |
|---|---|
| (Solution A) | |
| Sodium chloride | 3.42 g |
| Potassium bromide | 0.03 g |
| Water was added to make a 200 ml solution. | |
| (Solution B) | |
| Sodium nitrate | 10 g |
| Water was added to make a 200 ml solution | |
| (Solution C) | |
| Sodium chloride | 102.7 g |
| $K_2IrCl_6$ | $4 \times 10^{-8}$ mol Ag |
| $K_4Fe(CN)_6$ | $2 \times 10^{-5}$ mol Ag |
| Potassium bromide | 1.0 g |
| Water was added to make a 600 ml solution. | |
| (Solution D) | |
| Sodium nitrate | 300 g |
| Water was added to make a 600 ml solution. | |

After the addition was completed, the solution was subjected to desalting by the use of a 5% aqueous solution of Demol N produced by Kao Atlas Co., Ltd. and a 20% aqueous solution of magnesium sulfate. Then, the resulting solution was mixed with an aqueous gelatin solution to prepare a mono-dispersed cubic emulsion EMP-1 having an average grain size of 0.71 μm, a variation coefficient of grain size distribution of 0.07 and a silver chloride content of 99.5 mol %. The mono-dispersed cubic emulsion EMP-1B was prepared in the same manner as in EMP-1, except that the addition time of Solutions A And B, and the addition time of Solutions C And D were varied. The emulsion EMP-1B had an average grain size of 0.64 μm, a variation coefficient of grain size distribution of 0.07 and a silver chloride content of 99.5 mol %.

The above-mentioned emulsions EMP-1 and EMP-1B were subjected to the most suitable sensitization employing the following compounds. Then, the sensitized EMP-1 and EMP-1B were mixed in a ratio (in terms of silver) of 1:1 to obtain a blue sensitive silver halide emulsion (Em-B).

| | |
|---|---|
| Sodium thiosulfate | 0.8 mg/mol Ag |
| Chloroauric acid | 0.5 mg/mol Ag |
| Stabilizer STAB-1 | $3 \times 10^{-4}$ mol/mol Ag |
| Stabilizer STAB-2 | $3 \times 10^{-4}$ mol/mol Ag |
| Stabilizer STAB-3 | $3 \times 10^{-4}$ mol/mol Ag |
| Sensitizer BS-1 | $4 \times 10^{-4}$ mol/mol Ag |
| Sensitizer BS-2 | $1 \times 10^{-4}$ mol/mol Ag |

(Preparation of green sensitive silver halide emulsion)

The mono-dispersed cubic emulsion EMP-2 was prepared in the same manner as in EMP-1, except that the addition time of Solutions A And B, and the addition time of Solutions C And D were varied. The emulsion EMP-2 had an average grain size of 0.40 μm, a variation coefficient of 0.08 and a silver chloride content of 99.5 mol %. The mono-dispersed cubic emulsion EMP-2B, which had an average grain size of 0.38 μm, a variation coefficient of 0.08 and a silver chloride content of 99.5 mol %, was prepared in the same manner as in EMP-2.

The above-mentioned emulsions EMP-2 and EMP-2B were subjected to the most suitable sensitization employing the following compounds. Then, the sensitized EMP-2 and EMP-2B were mixed in a ratio (in terms of silver) of 1:1 to obtain a green sensitive silver halide emulsion (Em-G).

| | |
|---|---|
| Sodium thiosulfate | 1.5 mg/mol Ag |
| Chloroauric acid | 1.0 mg/mol Ag |
| Stabilizer STAB-1 | $3 \times 10^{-4}$ mol/mol Ag |
| Stabilizer STAB-2 | $3 \times 10^{-4}$ mol/mol Ag |
| Stabilizer STAB-3 | $3 \times 10^{-4}$ mol/mol Ag |
| Sensitizer GS-1 | $4 \times 10^{-4}$ mol/mol Ag |

(Preparation of red sensitive silver halide emulsion)

The mono-dispersed cubic emulsion EMP-3 was prepared in the same manner as in EMP-1, except that the addition time of Solutions A And B, and the addition time of Solutions C And D were varied. The emulsion EMP-3 had an average grain size of 0.40 μm, a variation coefficient of 0.08 and a silver chloride content of 99.5 mol %. The mono-dispersed cubic emulsion EMP-3B, which had an average grain size of 0.38 μm, a variation coefficient of 0.08 and a silver chloride content of 99.5 mol %, was prepared in the same manner as in EMP-3.

The above-mentioned emulsions EMP-3 and EMP-3B were subjected to the most suitable sensitization employing the following compounds. Then, the sensitized EMP-3 and EMP-3B were mixed in a ratio (in terms of silver) of 1:1 to obtain a red sensitive silver halide emulsion (Em-R).

| | |
|---|---|
| Sodium thiosulfate | 1.8 mg/mol Ag |
| Chloroauric acid | 2.0 mg/mol Ag |
| Stabilizer STAB-1 | $3 \times 10^{-4}$ mol/mol Ag |
| Stabilizer STAB-2 | $3 \times 10^{-4}$ mol/mol Ag |
| Stabilizer STAB-3 | $3 \times 10^{-4}$ mol/mol Ag |
| Sensitizer RS-1 | $1 \times 10^{-4}$ mol/mol Ag |
| Sensitizer RS-2 | $1 \times 10^{-4}$ mol/mol Ag |

STAB-1: 1-(3-acetoamidophenyl)-5-mercaptotetrazole

STAB-2: 1-phenyl-5-mercaptotetrazole

STAB-3: 1-(4-ethoxyphenyl)-5-mercaptotetrazole

SS-1 was added to the red sensitive emulsion in an amount of $2\times10^{-3}$ mol/mol Ag.

BS-1

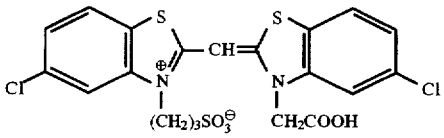

BS-2

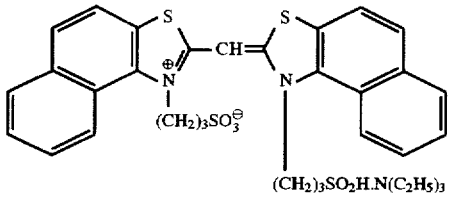

GS-1

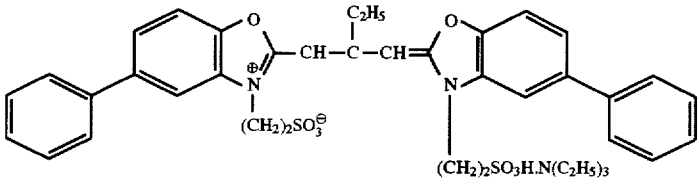

RS-1

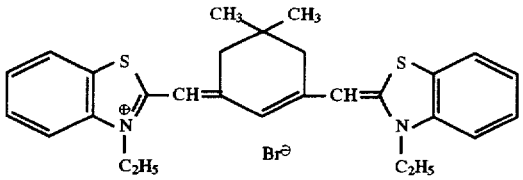

RS-2

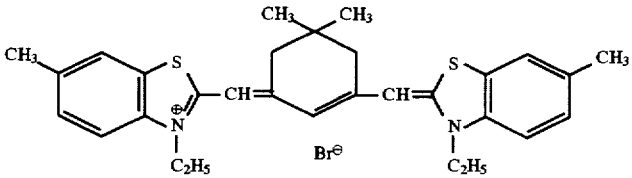

Thus obtained sample was designated as sample 101. Further, samples 301 through 317 were prepared in the same manner as in sample 101, except that the support as shown in Table 3 was used and cyan couplers as shown in Table 3 was used instead of C-I-4. The resulting samples were evaluated as follows:

<Evaluation of aging deterioration of image sharpness>

The samples were exposed to a red light through a resolving power test chart, and processed according to the following process. The density of the cyan image was measured by means of a microdensitometer PDM-5D (produced by Konica Corporation), and the value obtained by the following equation was designated as sharpness of fresh samples.

Sharpness of fresh sample=(Dmax−Dmin) at 3 lines/mm image/(Dmax−Dmin) at an image of large area wherein Dmax represents a maximum density, and Dmin represents a minimum density.

The above evaluated fresh samples were stored for 14 days at 75° C. and at 60% RH, and then evaluated for sharpness in the same manner as above.

The sharpness deterioration degree after the storage was obtained by the following equation.

Sharpness deterioration degree=Sharpness after the 14 day storage (%)/Sharpness of fresh sample (%)

The closer to 1 this value, the less the sharpness deterioration degree.

<Evaluation of aging deterioration of glossiness>

The samples were exposed to a white light and processed according to the following process A. The surface glossiness of the resulting black image was measured at an incident light angle of 60° and at a light receiving angle 60° by means of a glossmeter type VG-ID (produced by Nihon Denshoku Corporation), and the value above obtained was designated as glossiness of fresh samples.

The above glossiness evaluated fresh samples were stored for 14 days at 75° C. and at 60% RH, and then evaluated for glossiness in the same manner as above.

The glossiness deterioration degree after the storage was obtained by the following equation.

Glossiness deterioration degree=Glossiness after the 14 day storage (%)/Glossiness of fresh sample (%)

The closer to 1 this value, the less the Glossiness deterioration degree.

<Evaluation of aging coloration of white background>

The unexposed samples were processed according to the following process A, and were stored for one month at 40° C. and at 80% RH. The coloration (after-yellowing) of white background of the resulting samples was visually evaluated.

The evaluation criteria are as follows:

○: Little coloration, extremely excellent

◎: Slight coloration, excellent

Δ: Coloration is observed but no problem

X: Much coloration, problematic.

<Color fading in the dark (cyan image)>

The samples were wedge exposed to a red light, and processed according to the following process A. The density of the above obtained cyan image was measured at portions having a red light reflection density of 1.0, using a densitometer PDA-65 (produced by Konica Corporation). The processed samples were stored for 20 days at 85° C. and at 60% RH, and the blue density after the storage was measured in the same manner as above. Thus, remaining rate (%) at initial density 1.0 of the dye image was obtained and evaluated.

The above obtained samples were wedge exposed according to a conventional method, and processed according to the following developing processes.

| Processing step | Processing temperature | Time | Amount of replenishing |
|---|---|---|---|
| Color developing | 38.0 ± 0.3° C. | 45 seconds | 80 cc/m$^2$ |
| Bleach-fixing | 35.0 ± 0.5° C. | 45 seconds | 120 cc/m$^2$ |
| Stabilizing | 30–34° C. | 60 seconds | 150 cc/m$^2$ |
| Drying | 60–80° C. | 30 seconds | |

The following shows a composition of a color developing solution.

Color developer and color developer replenisher

| | Color developer | Color developer replenisher |
|---|---|---|
| Pure water | 800 cc | 800 cc |
| Triethylenediamine | 2 g | 3 g |
| Diethylene glycol | 10 g | 10 g |
| Potassium bromide | 0.01 g | |
| Potassium chloride | 3.5 g | |
| Potassium sulfite | 0.25 g | 0.5 g |
| N-ethyl-N-(β-methanesulfonamidoethyl)-3-methyl-4-aminoaniline sulfate | 6.0 g | 10.0 g |
| N,N-diethylhydroxylamine | 6.8 g | 6.0 g |
| Triethanolamine | 10.0 g | 10.0 g |
| Sodium diethylenetriamine pentaacetate | 2.0 g | 2.5 g |
| Fluorescent brightening agent (4,4'-diaminostylbenzsulfonate derivative) | 2.0 g | 2.5 g |
| Potassium carbonate | 30 g | 30 g |

Water was added to make 1 l in total. The pH's of color developer and color developer replenisher were regulated to 10.10 and 10.60, respectively.

Bleach fixer and bleach fixer replenisher

| | |
|---|---|
| Diethylenetriamine pentaacetate ferric ammonium dihydrate | 65 g |
| Diethylenetriamine pentaacetate | 3 g |
| Ammonium thiosulfate (70% aqueous solution) | 100 ml |
| 2-Amino-1,3,4-thiadiazole-2-thiol | 2.0 g |
| Ammonium thiosulfate (40% aqueous solution) | 27.5 ml |

Water was added to make 1 liter in total, and pH was regulated to 5.0 with potassium carbonate or glacial acetic acid.

Stabilizer and stabilizer replenisher

| | |
|---|---|
| Orthophenylphenol | 1.0 g |
| 5-chloro-2-methyl-4-isothiazoline-3-on | 0.02 g |
| 2-methyl-4-isothiazoline-3-on | 0.02 g |
| Diethyleneglycol | 1.0 g |
| Fluorescent brightening agent (Thinopal SFP) | 2.0 g |
| 1-Hydroxyethylidene-1,1-diphosphonic acid | 1.8 g |
| Bismuth chloride (45% aqueous solution) | 0.65 g |
| Magnesiuin sulfate heptahydrate | 0.2 g |
| PVP | 1.0 g |
| Aqueous ammonia (25% aqueous solution of ammonium hydroxide) | 2.5 g |
| Trisodium nitrilotriacetate | 1.5 g |

Water was added to make 1 liter in total, and pH was regulated to 7.5 with sulfuric acid or aqueous ammonia.

The results are shown in Table 3.

TABLE 3

| Sample | Support | Cyan coupler | Aging glossiness deterioration | Aging sharpness deterioration | Aging coloration of white background | Color fading in the dark | Remarks |
|---|---|---|---|---|---|---|---|
| 101 | A | C-I-4 | 0.70 | 0.71 | D | 82 | Comparative |
| 301 | A | C-A | 0.87 | 0.85 | D | 36 | Comparative |
| 302 | C | C-I-2 | 0.83 | 0.82 | C | 84 | Comparative |
| 303 | D | C-A | 0.88 | 0.87 | B | 38 | Comparative |
| 304 | E | C-2 | 0.94 | 0.90 | B | 88 | Invention |
| 305 | F | C-15 | 0.92 | 0.92 | B | 87 | Invention |
| 306 | G | C-I-7 | 0.93 | 0.96 | B | 86 | Invention |
| 307 | H | C-11 | 0.92 | 0.94 | A | 88 | Invention |
| 308 | I | C-39 | 0.93 | 0.93 | A | 87 | Invention |
| 309 | J | C-I-4 | 0.91 | 0.91 | B | 86 | Invention |
| 310 | K | C-29 | 0.90 | 0.95 | A | 85 | Invention |
| 311 | D | C-4 | 0.90 | 0.90 | C | 88 | Invention |
| 312 | F | C-20 | 0.94 | 0.94 | B | 90 | Invention |
| 313 | G | C-I-1 | 0.95 | 0.94 | A | 90 | Invention |
| 314 | I | C-39 | 0.93 | 0.93 | A | 86 | Invention |
| 315 | K | C-I-5 | 0.94 | 0.91 | B | 85 | Invention |
| 316 | B | C-6 | 0.82 | 0.81 | C | 83 | Comparative |
| 317 | L | C-14 | 0.82 | 0.81 | C | 83 | Comparative |

Comparative cyan coupler

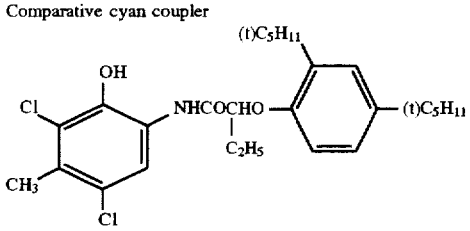

(C-A)

As is apparent from the above, inventive samples are superior to comparative samples.

Example 2

The processing was carried out in the same manner as in Example 1, except that the processing was varied as follows:

| Processing step | Processing temperature | Time | Amount of replenishing |
|---|---|---|---|
| Color developing | 38.0 ± 0.3° C. | 22 seconds | 81 ml |
| Bleach-fixing | 35.0 ± 0.5° C. | 22 seconds | 54 ml |
| Stabilizing | 30–34° C. | 25 seconds | 150 ml |
| Drying | 60–80° C. | 30 seconds | |

The following shows a composition of a color developing solution.

Color developer and color developer replenisher

| | Color developer | Color developer replenisher |
|---|---|---|
| Pure water | 800 ml | 800 ml |
| Diethylene glycol | 10 g | 10 g |
| Potassium bromide | 0.01 g | |
| Potassium chloride | 3.5 g | |
| Potassium sulfite | 0.25 g | 0.5 g |
| N-ethyl-N-(β-methanesulfonamidoethyl)-3-methyl-4-aminoaniline sulfate | 6.5 g | 10.5 g |
| N,N-diethylhydroxylamine | 3.5 g | 6.0 g |
| N,N-bis(2-sulfoethyl)hydroxylamine | 3.5 g | 6.0 g |
| Triethanolamine | 10.0 g | 10.0 g |
| Sodium diethylenetriamine pentaacetate | 2.0 g | 2.0 g |

-continued

| | Color developer | Color developer replenisher |
|---|---|---|
| Fluorescent brightening agent (4,4'-diaminostylbenzsulfonate derivative) | 2.0 g | 2.5 g |
| Potassium carbonate | 30 g | 30 g |

Water was added to make 1 l in total. The pH's of color developer and color developer replenisher were regulated to 10.10 and 10.60, respectively.

Bleach fixer and bleach fixer replenisher

| | Bleach fixer | Bleach fixer replenisher |
|---|---|---|
| Diethylenetriamine pentaacetate ferric ammonium dihydrate | 100 g | 50 g |
| Diethylenetriamine pentaacetate | 3 g | 3 g |
| Ammonium thiosulfate (70% aqueous solution) | 200 ml | 100 ml |
| 2-Amino-5-mercapto-1,3 4-thiadiazole | 2.0 g | 1.0 g |
| Ammonium sulfite (40% aqueous solution) | 50 ml | 25 ml |

Water was added to make 1 liter in total, and the pH's of bleach fixer and bleach fixer replenisher was regulated to 7.0 and 6.5, respectively, with potassium carbonate or glacial acetic acid.

Stabilizer and stabilizer replenisher

| | |
|---|---|
| Orthophenylphenol | 1.0 g |
| 5-chloro-2-methyl-4-isothiazoline-3-on | 0.02 g |
| 2-methyl-4-isothiazoline-3-on | 0.02 g |
| Diethyleneglycol | 1.0 g |
| Fluorescent brightening agent (Thinopal SFP) | 2.0 g |
| 1-hydroxyethylidene-1,1-diphosphonic acid | 1.8 g |
| PVP | 1.0 g |
| Aqueous ammonia (25% aqueous solution of ammonium hydroxide) | 2.5 g |
| Ethylenediamine tetraacetic acid | 1.0 g |
| Ammonium sulfite (40% aqueous solution) | 10 ml |

Water was added to make 1 liter in total, and pH was regulated to 7.5 with sulfuric acid or aqueous ammonia.

The processing was conducted in the same manner as in Example 1, and the effects of the invention were obtained.

Example 3

The running processing was conducted in the same manner as in Example 2, except that an automatic processor NPS-868J produced by Konica Corporation, a processing agent ECO JET-P and processing name CPK-2-J1 were used. The same evaluation as Example 1 was conducted, and it has proved that the effects of the invention was obtained.

What is claimed is:

1. A silver halide color photographic material comprising a paper support, and provided thereon, a light sensitive silver halide emulsion layer and a non-light sensitive layer, said support comprising a paper base and a resin layer coated on each side of the paper base, the resin layer on the silver halide emulsion layer side comprising two or more resin layers containing white pigment and having a different white pigment content, at least one of the resin layers being composed of a polyolefin or polyester resin, and at least another one layer being composed of a resin selected from the group consisting of a polyester resin, a polyether resin, a polyurethane resin, a polycarbonate resin, a polystyrene resin, a cellulose derivative and an electron beam hardened resin, wherein the silver halide emulsion layer comprises a silver halide emulsion having a silver chloride content of 95 to 99.9 mol % and contains at least one cyan coupler selected from a compound represented by the following Formula [C-1] or, Formula [I], [II], [III] or [IV]:

Formula [C-1]

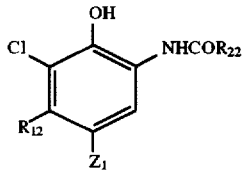

wherein $R_{21}$ represents an alkyl group having 2 to 6 carbon atoms; $R_{22}$ represents a ballast group; and $Z_1$ represents a hydrogen atom or an atom or group capable of being released on reaction with an oxidation product of a color developing agent.

Formula [I]

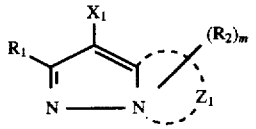

-continued

Formula [II]

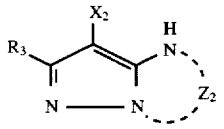

Formula [III]

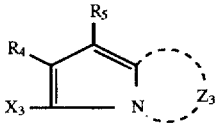

Formula [IV]

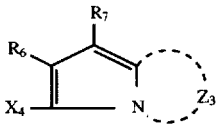

wherein $R_1$ represents a hydrogen atom or a substituent; $R_2$ is a substituent; m is the number of substituent $R_2$, provided when m is zero, $R_1$ represents an electron attractive group having a Hammett's substituent constant $\sigma_p$ of not less than 0.20, while when m is 1, 2 or more, at least one of $R_1$ and $R_2$ represents an electron attractive group having a Hammett's substituent constant $\sigma_p$ of not less than 0.20; $Z_1$ represents a group of non-metallic atoms necessary to form a nitrogen-containing 5-membered heterocyclic ring; $R_3$ represents a hydrogen atom or a substituent; $Z_2$ represents a group of non-metallic atoms necessary to form a nitrogen-containing 6-membered heterocyclic ring together with —NH—, which may have a substituent; $R_4$ and $R_5$ each represent an electron attractive group having a Hammett's substituent constant $\sigma_p$ of not less than 0.20, provided the sum of $\sigma_p$ values of $R_4$ and $R_5$ is not less than 0.65; $Z_3$ represents a group of non-metallic atoms necessary to form a nitrogen-containing 5-membered heterocyclic ring, which may have a substituent; $R_6$ and $R_7$ each represent a hydrogen atom or a substituent; $Z_4$ represents a group of non-metallic atoms necessary to form a nitrogen-containing 6-membered heterocyclic ring, which may have a substituent; and $X_1$, $X_2$, $X_3$ and $X_4$ each represent a hydrogen atom or a group capable of being released upon coupling reaction with an oxidation product of a color developing agent.

2. The material of claim 1, wherein the silver halide emulsion layer contains said cyan coupler in an amount of $1\times10^{-3}$ to 1 mol per mol of silver halide.

3. The material of claim 1, wherein $R_{22}$ represents —CH($R_{23}$)—OAr in which $R_{23}$ represents an alkyl group having 1 to 12 carbon atoms and Ar represents an aryl group; $Z^1$ represents a halogen atom or an alkoxy, aryloxy, acyloxy, sulfonyloxy, acylamino, sulfonylamino, alkoxycarbonyl, aryloxycarbonyloxy group or imido group; the substituent represented by $R_1$ or $R_2$ represents an alkyl, aryl, anilino, acylamino, sulfonamido, alkylthio, arylthio, alkenyl, cycloalkyl, cycloalkenyl, alkynyl, heterocyclic, alkoxy, aryloxy, heterocylic oxy, siloxy, amino, alkylamino, imido, ureido, sulfamoylamino, alkoxycarbonylamino, aryloxycarbonylamino, alkoxycarbonyl, aryloxycarbonyl, heterocyclic thio, thioureido, hydroxy or mercapto group, a spiro compound residue or a closslinked hydrocarbon compound residue, or a group having a Hammett's substituent constant $\sigma_p$ of +0.20 or more including a sulfonyl, sulfinyl, sulfonyloxy, sulfamoyl, phosphoryl, carbamoyl, acyl, acyloxy, oxycarbonyl, carboxyl, cyano, nitro, halogenated alkoxy, halogenated aryloxy, pyrrolyl and tetrazolyl group and a halogen atom; $R_3$ represents an alkyl, aryl, anilino, acylamino, sulfonamido, alkylthio, arylthio, alkenyl or cycloalkyl group, a halogen atom, a cycloalkenyl, alkynyl, heterocyclic, sulfonyl, sulfinyl, phosphonyl, acyl, carbamoyl, sulfamoyl, cyano, alkoxy, sulfonyloxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic thio, thioureido, carboxyl, hydroxyl, mercapto, nitro and sulfo group, a spiro compound residue or a closslinked hydrocarbon conspound residue; the 6-membered nitrogen-containing heterocyclic ring formed with $Z_2$ represents a diazine, triazine or tetrazine; the substituent represented by $R_4$ or $R_5$ represents a sulfonyl, sulfinyl, sulfonyloxy, sulfamoyl, phosphoryl, carbamoyl, acyl, acyloxy, oxycarbonyl, carboxyl, cyano, nitro, halogenated alkoxy, halogenated aryloxy, pyrrolyl or tetrazolyl group or a halogen atom; the 5-membered nitrogen-containing heterocyclic ring formed with $Z_3$ represents a pyrazole ring, an imidazole ring or a tetrazole ring; $R_6$ and $R_7$ each represent an alkyl, aryl, anilino, acylamino, sulfonamido, alkylthio, arylthio, alkenyl or cycloalkyl group, a halogen atom, a cycloalkenyl, alkynyl, heterocyclic, sulfonyl, sulfinyl, phosphonyl, acyl, carbamoyl, sulfamoyl, cyano, alkoxy, sulfonyloxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic thio, thioureido, carboxyl, hydroxyl, mercapto, nitro and sulfo group, a spiro compound residue or a closslinked hydrocarbon conspound residue; $Z_4$ represents a group of non-metallic atoms necessary to form a nitrogen-containing 6-membered heterocyclic ring containing —NH—, —N(R)—, —N=, —CH(R)—, —CH=, —C(R)=, —CO—, —SO— or —$SO_2$—, in which R represents those represented by $R_3$; and the group represented by $X_1$, $X_2$, $X_3$ or $X_4$ capable of being released upon reaction with an oxidation product of a color developing agent represents a halogen atom, an alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclicthio, alkoxycarbonylthio, acylamino, sulfonamido, N atom-bonded nitrogen-containing heterocyclic, alkoxycarbonylamino, aryloxycarbonylamino or carboxyl group.

4. The material of claim 1, wherein a resin layer on the side of the paper support opposite the silver halide emulsion layer is composed of a polyolefin resin or a polyester resin.

5. The material of claim 1, wherein said at least one of the resin layers is composed of a polyolefin resin, and said at least another one layer is composed of a resin selected from the group consisting of a polyester resin, a polyether resin, a polyurethane resin, a polycarbonate resin, a polystyrene resin, a cellulose derivative and an electron beam hardened resin.

6. The material of claim 1, wherein the average white pigment content of said two or more resin layers is 16 weight % or more.

7. The material of claim 1, wherein the white pigment content of the resin layer closest to the silver halide emulsion layer is 1 to 25 weight %.

* * * * *

UNITED STATES PATENT AND TRADEMARK OFFICE

CERTIFICATE OF CORRECTION

PATENT NO. : 5,780,215
DATED : July 14, 1998
INVENTOR(S) : ITO

It is certified that error appears in the above-indentified patent and that said Letters Patent is hereby corrected as shown below:

Title Page, Item [57], in the Abstract, line 14, "rein" should read --resin--.

Claim 1, column 88, in Formula [IV],

" 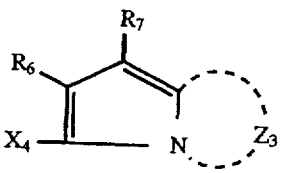 Formula [IV] " should read -- 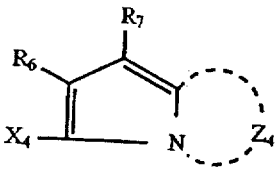 Formula [IV]--.

Claim 3, column 88, line 54, "heterocylic" should read --heterocyclic--.

Signed and Sealed this

Sixth Day of July, 1999

*Attest:*

Q. TODD DICKINSON

*Attesting Officer*

*Acting Commissioner of Patents and Trademarks*